US005337134A

United States Patent [19]

Sato et al.

[11] Patent Number: 5,337,134

[45] Date of Patent: Aug. 9, 1994

[54] SHEET INVERTING UNIT AND AN IMAGING FORMING APPARATUS EMPLOYING THE SAME

[75] Inventors: Kazuyasu Sato; Takashi Maekawa; Mitsuru Yamazaki, all of Kawasaki; Harumichi Oishi, Higashikurume, all of Japan

[73] Assignees: Fujitsu Limited, Kawasaki; Daiwa Seiko, Inc., Tokyo, both of Japan

[21] Appl. No.: 104,016

[22] Filed: Aug. 10, 1993

[30] Foreign Application Priority Data

| | | | |
|---|---|---|---|
| Aug. 11, 1992 | [JP] | Japan | 4-214054 |
| Aug. 11, 1992 | [JP] | Japan | 4-214055 |
| Sep. 28, 1992 | [JP] | Japan | 4-257923 |

[51] Int. Cl.[5] ..... G03G 21/00

[52] U.S. Cl. ..... 355/319; 271/186; 271/291

[58] Field of Search ..... 355/319, 318, 200, 210, 355/309; 271/186, 291

[56] References Cited

U.S. PATENT DOCUMENTS

| | | | |
|---|---|---|---|
| 4,568,169 | 2/1986 | Wada et al. | 271/186 |
| 4,954,848 | 9/1990 | Arima | 355/319 |
| 5,083,170 | 1/1992 | Sawada et al. | 355/319 |
| 5,257,068 | 10/1993 | Sawada et al. | 355/200 |

*Primary Examiner*—R. L. Moses
*Attorney, Agent, or Firm*—Staas & Halsey

[57] ABSTRACT

Disclosed are a single-side image forming device with a sheet inverting unit attached thereto for image forming on the reverse side of a sheet, and a double-side image forming apparatus that employs such a sheet inverting unit. The sheet inverting unit is detachable from an image forming apparatus, which has a sheet cassette; an image forming mechanism; a stacker; and a feeding path along which the sheet supplied from the sheet cassette is conveyed first to the image forming mechanism and then to the stacker. The sheet inverting unit comprises a switching lever for selectively guiding the image bearing sheet either toward the stacker or upward of the image forming device; switchback rollers for feeding the sheet guided upward by the switching lever and then inversely feeding the sheet; a guide path, which extends from the switchback rollers to a terminus in the vicinity of an inserting port of the image forming device; and feeding rollers provided along the guide path. The double-side image forming apparatus comprises: an image forming device, which has a sheet cassette, an image forming mechanism, a stacker, a feeding path along which the sheet is conveyed first to the image forming mechanism and then to the stacker, a manual inserting port, and a manual inserting path along which is conveyed an inserted sheet from the manual inserting port to the upstream origin of the feeding path for the image forming mechanism; and a sheet inverting unit that is structured as described above.

34 Claims, 15 Drawing Sheets

SHEET INVERTING UNIT AND AN IMAGING FORMING APPARATUS EMPLOYING THE SAME

BACKGROUND OF THE INVENTION

1. Field of the Invention

The present invention relates to a sheet inverting unit that inverses a sheet for image forming on a reverse surface and to a double-side image forming apparatus, which is equipped with a single-side image forming device, that employs the sheet inverting unit.

2. Description of the Related Art

Currently available, to satisfy a demand for plain paper image recording, are image forming apparatuses, such as copying machines, printers, and facsimiles, that employ a latent image forming recording apparatus similar to an electrophotographic apparatus. According to this image forming principle, a photosensitive drum, which is used as an image carrier, is charged, and the photosensitive drum is then exposed to a light image to form an electrostatic latent image on it. When the electrostatic latent image on the photosensitive drum is developed by a developing unit, a toner image is formed on the photosensitive drum. Then, the toner image is transferred from the photosensitive drum to a sheet of paper.

Such an image forming apparatus, however, normally forms an image on only one surface of a sheet, but there has recently arisen a demand for image forming apparatuses that can perform double-side image forming. If, however, paired image forming mechanisms were provided to print both sides of a sheet, the size of an image forming apparatus would increase and its per unit manufacturing cost would rise. A sheet inverting unit is therefore incorporated in an image forming apparatus to enable double-side image forming. After one surface of a sheet has been printed, this sheet inverting unit inverts the sheet, returns it to an image forming mechanism to print an image on the reverse of the sheet, and discharges it.

The above described image forming apparatus should be made compact. Particularly desirable is a small image forming apparatus that can perform double-side image forming while keeping its size.

FIGS. 1A and 1B are explanatory diagrams for conventional techniques. Of the conventional double-side image forming apparatuses, one type, described in, for example, U.S. Pat. No. 4,814,743, incorporates a sheet inverting unit, and another, described in, for example Japanese Unexamined Patent Publication No. 138262/1986 and No. 42774/1986, has an attached a sheet inverting unit.

A general arrangement for a double-side image forming apparatus that incorporates a sheet inverting unit will now be described while referring to FIG. 1A. In single-side printing, an image forming apparatus 1 feeds a sheet from a hopper 153, which protrudes from the image forming apparatus 1, along a feeding path to an image forming process mechanism 151, and prints the obverse side of the sheet. The sheet is then discharged to a tray 152.

In double-side printing, however, the image forming apparatus 1 employs a switching lever LV to guide a single side printed sheet to a feedback path FP where the sheet is inverted. The inverted sheet is fed to and switched by an externally provided inverting guide 154, and is refed to the image forming process mechanism 151. After the reverse of the sheet has been printed, the sheet is discharged to the tray 152.

A general arrangement for an image forming apparatus that has an externally attached sheet inverting unit will now be explained while referring to FIG. 1B. In single-side printing, a sheet inverting unit 155 is provided beneath an image forming apparatus 150. A sheet from the hopper 153, which protrudes from the image forming apparatus 150, is guided along a feeding path to the image forming process mechanism 151 and the obverse of the sheet is printed. The printed sheet is then discharged to the tray 152.

In double-side printing, however, the single-side printed sheet is guided by a switching lever LV from the discharge port of the image forming apparatus 150 to a sheet inverting unit 155. After the sheet is switched back by a sheet inverting mechanism 156 of the sheet inverting unit 155, it is guided to a feedback path FP and inverted. The inverted sheet is carried to the insertion port of the image forming apparatus 150, and from there is refed to the image forming process mechanism 151. Printing is performed on the reverse of the sheet and the double-side printed sheet is discharged to the tray 152.

According to the well known techniques, as the sheet feedback path extends beyond either side of the image forming apparatus 150, the size of a double-side image forming apparatus is increased. Also, since mechanisms for double-side image forming, such as a switching lever, must be installed within the image forming apparatus 150, the cost of the image forming apparatus 150 will rise and its size will increase. Further, because of the long feeding path provided for the image forming apparatus shown in FIG. 1A, more time is required for double-side image forming. And as the image forming apparatus shown in FIG. 1B cannot be opened to provide access to the feedback path FP in the sheet inverting unit 155, it is difficult to remove a jammed sheet from the sheet inverting unit 155.

SUMMARY OF THE INVENTION

It is, therefore, an object of the present invention to provide a sheet inverting unit that does not increase the size of an image forming apparatus while enabling double-side image forming, and a double-side image forming apparatus that can employ such a sheet inverting unit.

It is another object of the present invention to provide a sheet inverting unit that has a short feeding path for double-side image forming to improve processing speed, and a double-side image forming apparatus that can employ such a sheet inverting unit.

It is still another object of the present invention to provide such sheet inverting unit and double-side image forming apparatus that a special mechanism for double-side image forming is not necessary to be equipped and double-side image forming can be performed.

It is yet another object of the present invention to provide an inexpensive sheet inverting unit for double-side image forming and a double-side image forming apparatus.

To achieve these objects, according to one aspect of the present invention a sheet inverting unit, which is detachable from an image forming apparatus having a sheet cassette, an image forming mechanism provided above the sheet cassette for forming an image on one side of a sheet, a stacker provided above the image forming mechanism, a feeding path along which the sheet supplied from the sheet cassette is conveyed to the stacker through the image forming mechanism, an inserting port for manual sheet feeding, and an inserting path along which is conveyed an inserted sheet from the inserting port to the upstream origin of the feeding path for the image forming mechanism, for inverting the sheet bearing an image on one surface received from the image forming apparatus feeding the image bearing sheet to the image forming apparatus, comprises: a switching lever, provided downstream along the feeding path for the image forming mechanism, for selectively guiding the image bearing sheet either toward the stacker or upward of the image forming apparatus; switchback rollers for feeding, upward of the stacker, the image bearing sheet that is guided upward by the switching lever and then inversely feeding the image bearing sheet; a guide path, which extends from the switchback rollers to a terminus in the vicinity of the inserting port of the image forming apparatus; and feeding rollers, provided along the guide path of the sheet inverting unit, for feeding the image bearing sheet to the image forming apparatus.

According to another aspect of the present invention, a double-side image forming apparatus, for forming images on both sides of a sheet, comprises: a sheet cassette for retaining sheets, an image forming device provided above the sheet cassette, for forming an image on one side of a sheet supplied from the sheet cassette, a stacker that is provided above the image forming mechanism for holding an image bearing sheet, a feeding path along which the sheet supplied from the sheet cassette is conveyed to the stacker through the image forming mechanism, an inserting port for manual sheet insertion, and an inserting path a manually inserted sheet is fed from the inserting port to the upstream origin of the feeding path for the image forming mechanism; and a sheet inverting unit for inverting and feeding a sheet bearing an image on one side to the image forming device, the sheet inverting unit having a switching lever provided downstream along the feeding path of the image forming mechanism for selectively guiding the image bearing sheet either toward the stacker or upward of the image forming device, switchback rollers for feeding, upward of the stacker, the image bearing sheet that is guided upward by the switching lever and then inversely feeding the image bearing sheet, a guide path that extends from the switchback rollers to a terminus in the vicinity of the inserting port of the image forming device, and feeding rollers provided along the guide path for feeding the image bearing sheet to the image forming device.

According to this aspect, first, since the space above a stacker, defined by the feeding path of an image forming apparatus, is utilized for a switchback route, a switchback route can be situated over and within the horizontal area of the image forming apparatus. A sheet inverting unit and a double-side image forming apparatus that employs the sheet inverting unit can therefore be compactly constructed.

Second, by employing a sheet refeeding port as an inserting port of an image forming apparatus, the guide path of the sheet inverting unit can be shortened and processing time reduced. In addition, since a resist roller or the like are not necessary for a sheet inverting unit, the unit can be compactly constructed, and can be mounted on the side of the image forming apparatus, thus providing a small double-side image forming apparatus.

Third, as a switching lever and feeding rollers are included in a sheet inverting unit, and an inserting port of an image forming apparatus serves as a sheet refeeding port, the image forming apparatus does not require any double-side image forming mechanism. Accordingly, by merely mounting a sheet inverting unit on a single-side image forming apparatus, the apparatus can be adapted to provide a double-side image forming.

According to still another aspect of the present invention, a double-side image forming apparatus, for forming images on both sides of a sheet, comprises: a sheet cassette for retaining sheets, an image forming mechanism provided above the sheet cassette for forming an image on one side of a sheet supplied from the sheet cassette, a stacker provided above the image forming mechanism for holding an image bearing sheet, a feeding path along which the sheet supplied from the sheet cassette is fed to the stacker through the image forming mechanism, an insertion port for sheet insertion, and an insertion path along which an inserted sheet is fed from the insertion port to the upstream origin of the feeding path for the image forming mechanism; and a sheet inverting unit for inverting and feeding a sheet bearing an image on one side to the image forming device, the sheet inverting unit having a switching lever provided downstream along the feeding path of the image forming mechanism for selectively guiding the image bearing sheet either toward the stacker or upward of the image forming device, switchback rollers for feeding, upward of the stacker, the image bearing sheet that is guided upward by the switching lever and then inversely feeding the image bearing sheet, a guide path that extends from the switchback rollers to a terminus in the vicinity of the insertion port of the image forming device, and feeding rollers provided along the guide path for feeding the image bearing sheet to the image forming device.

According to this aspect, since the space above a stacker, defined by the feeding path of an image forming apparatus, is utilized for a switchback route, a switchback route can be situated over and within the horizontal area of the image forming apparatus. A sheet inverting unit and a double-side image forming apparatus that employs the sheet inverting unit can therefore be compactly constructed. Also, by employing a sheet refeeding port as an insertion port of an image forming device, the guide path of the sheet inverting unit can be shortened and processing time reduced. In addition, since a resist roller or the like are not necessary for a sheet inverting unit, the unit can be compactly constructed, and can be mounted on the side of the image forming apparatus, thus providing a small double-side image forming apparatus.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above, and the detailed description of the preferred embodiments given below, serve to explain the principle of the invention.

DETAILED DESCRIPTION OF THE PREFERRED EMBODIMENTS

Figure 1A:
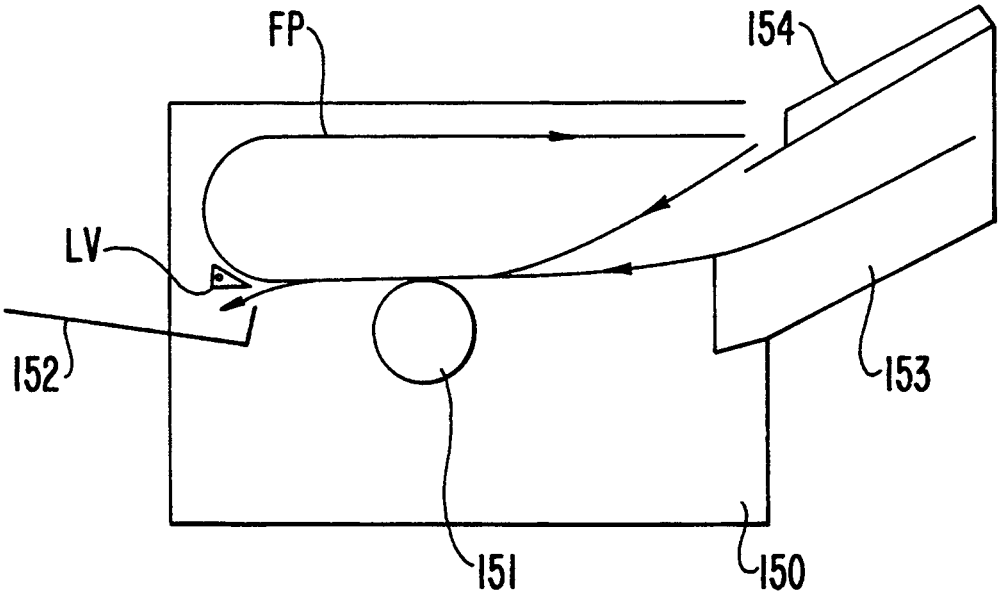
FIG. 1A (PRIOR ART)
FIGS. 1A and 1B are diagrams illustrating prior art.
Figure 1B:
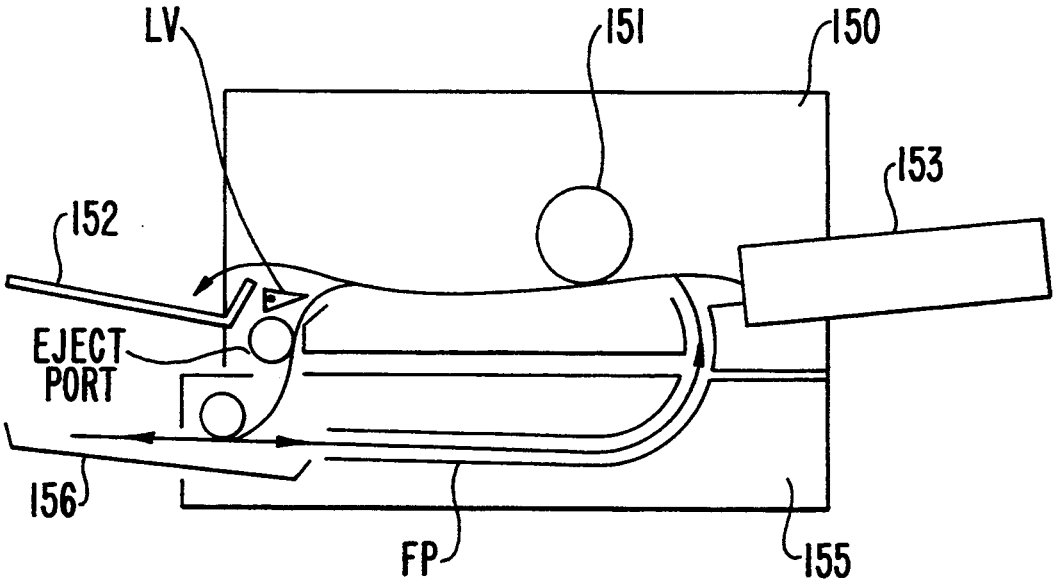
FIG. 1B (PRIOR ART)
Figure 2:
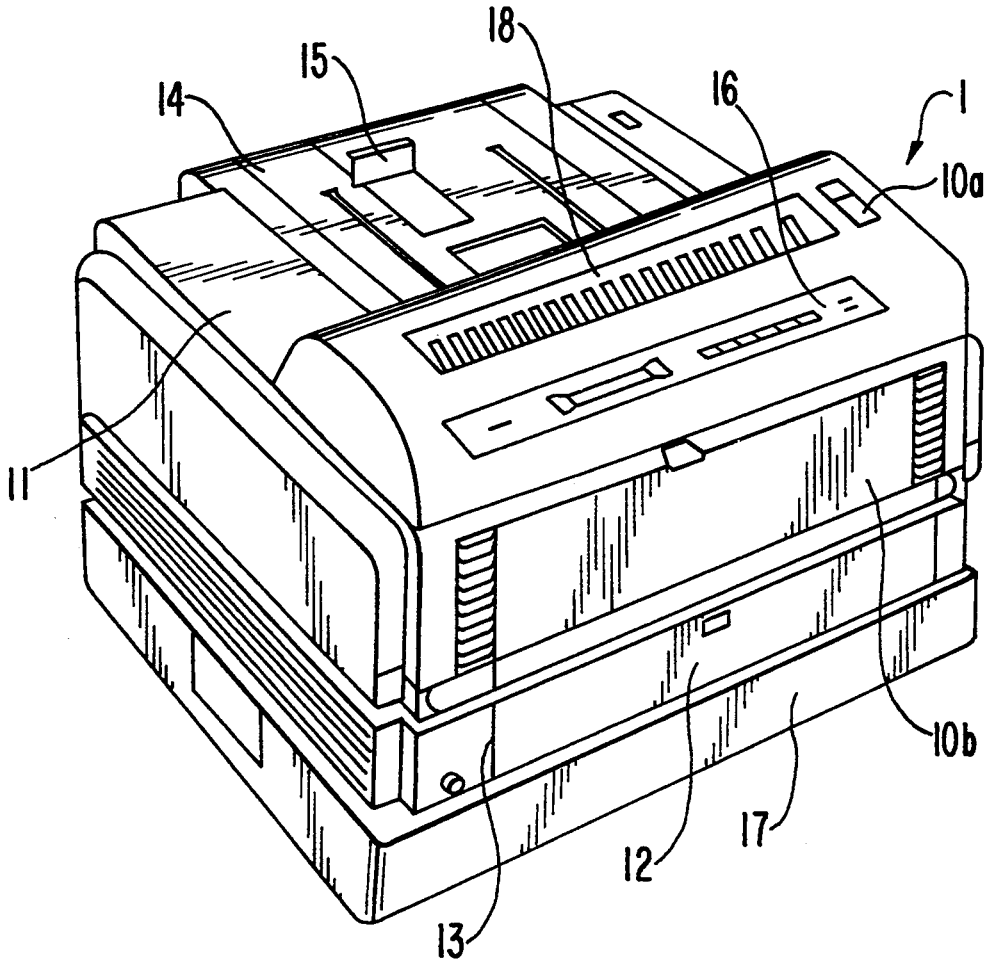
FIG. 2 is a perspective view showing the outline of an image forming apparatus according to one embodiment of the present invention.
Figure 3:
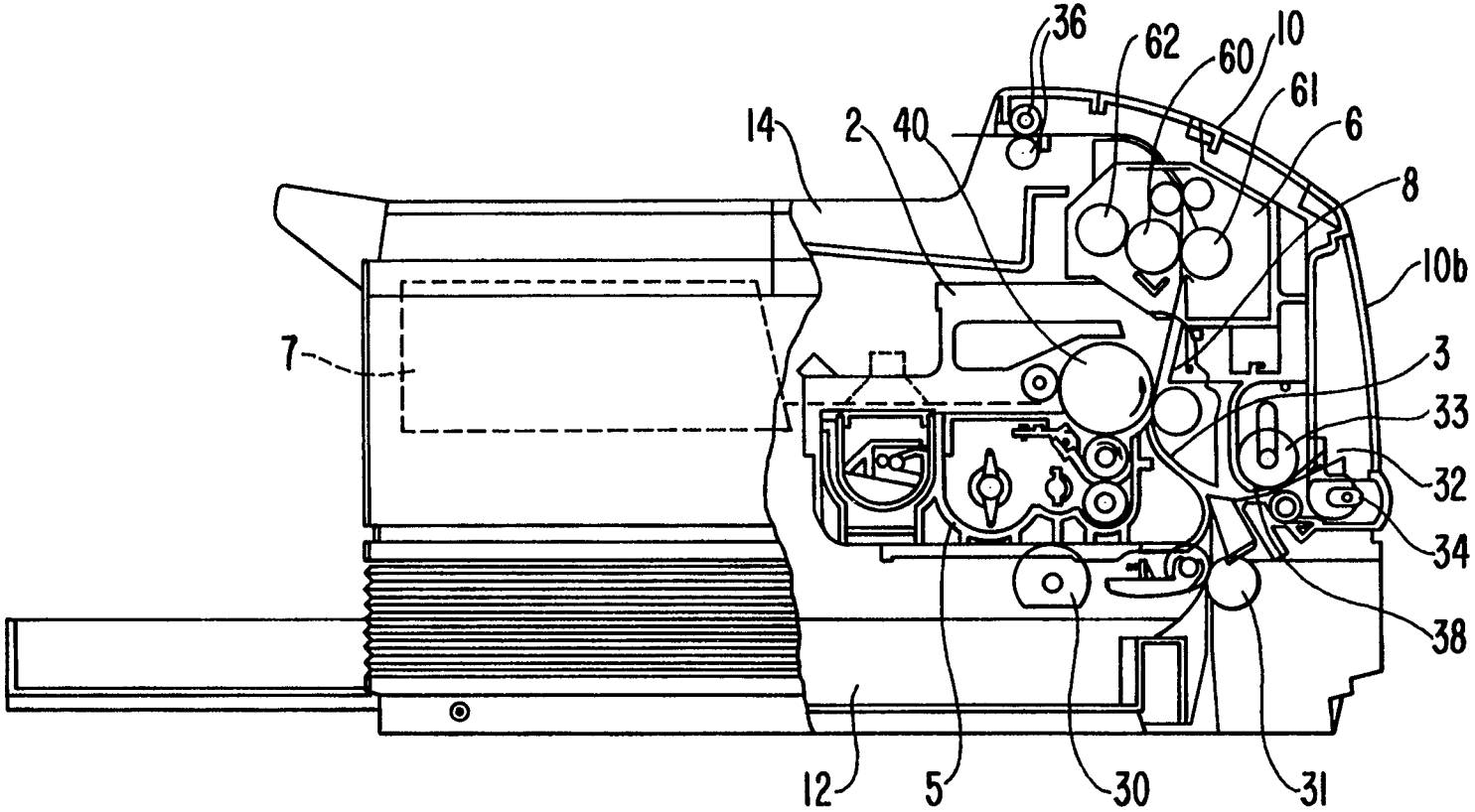
FIG. 3 is a cross sectional view of the interior of the image forming apparatus shown in FIG. 2.
Figure 4:
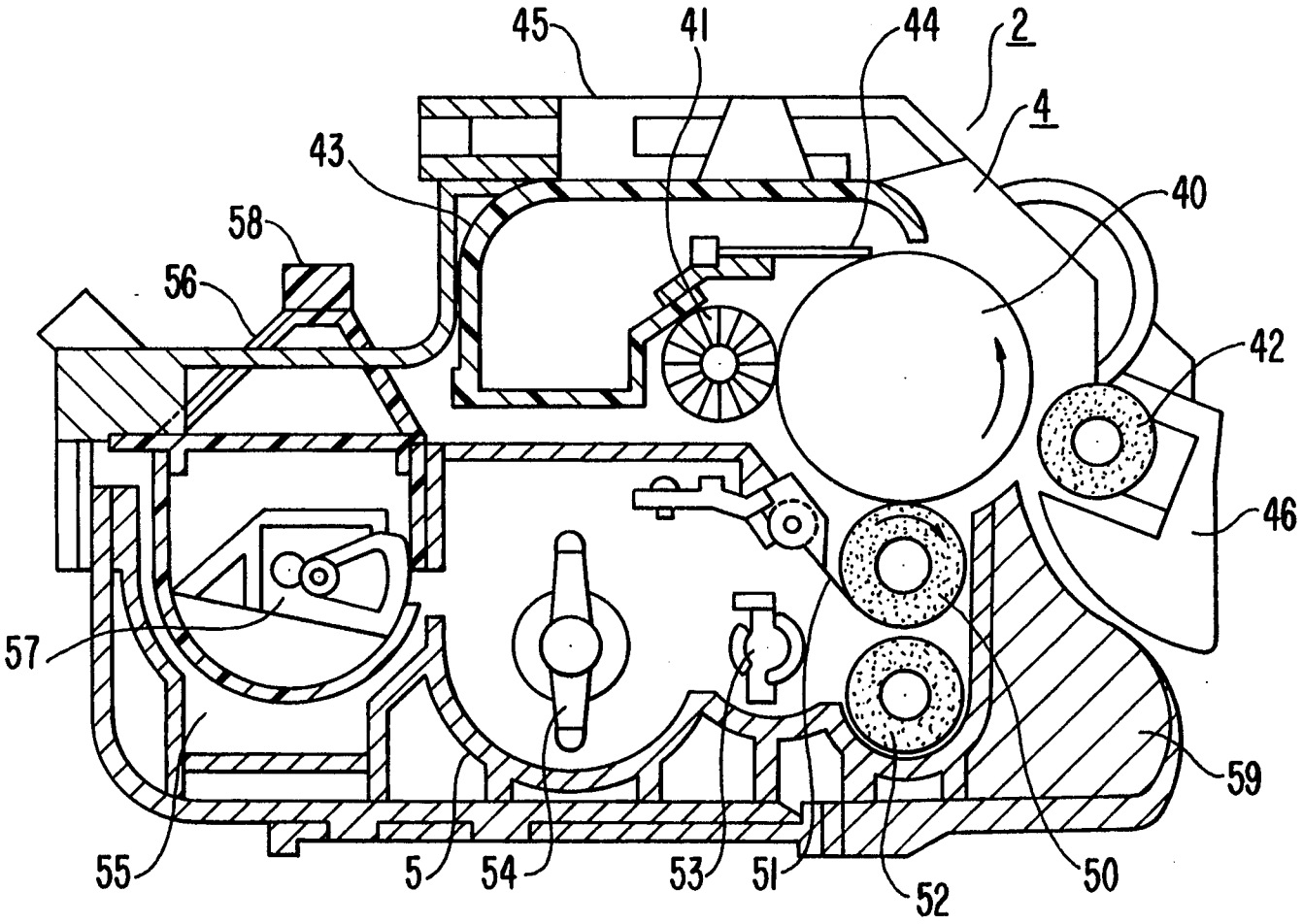
FIG. 4 is a cross sectional view showing a process cartridge for the image forming apparatus shown in FIG. 3.
Figure 5:
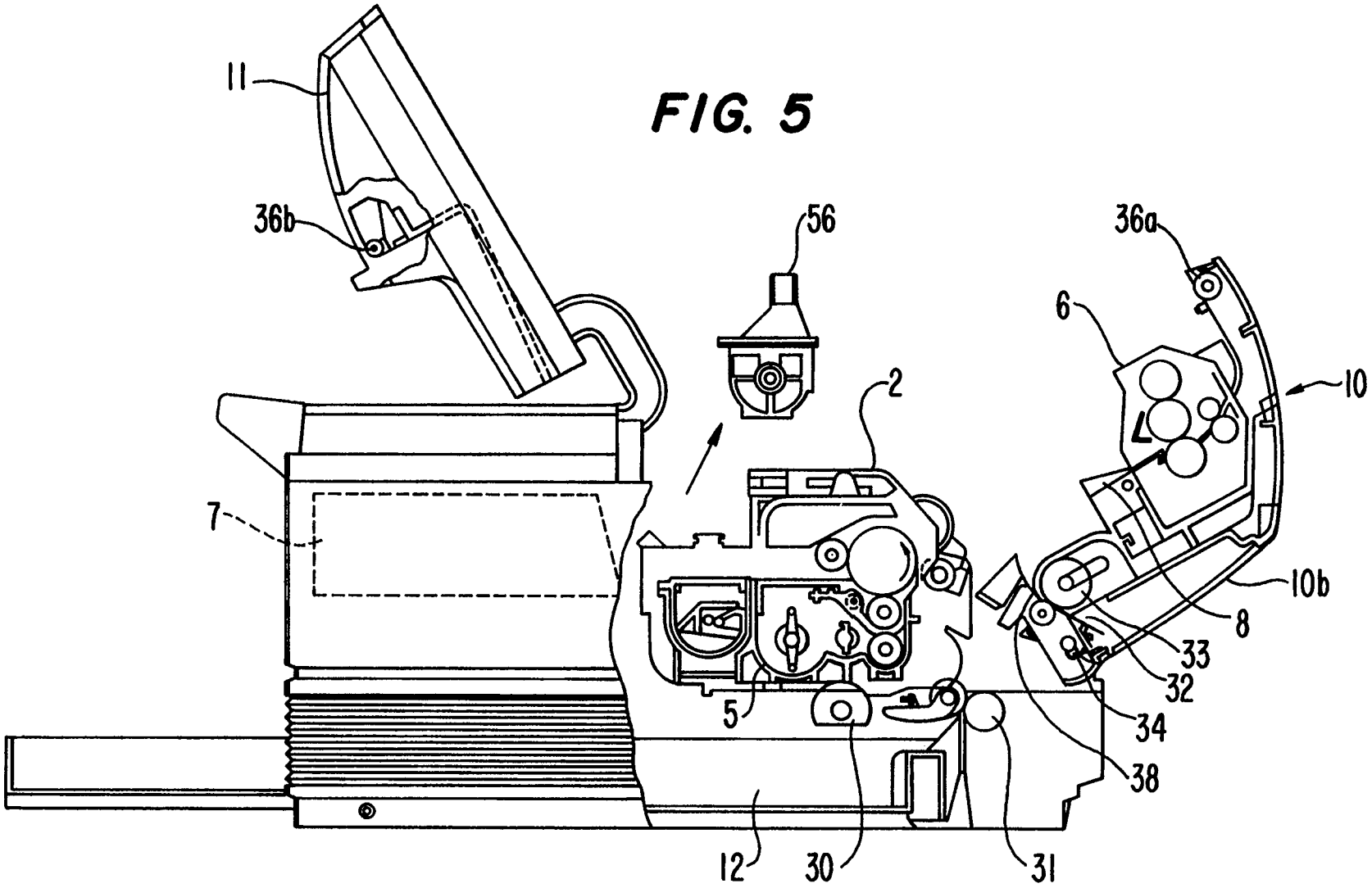
FIG. 5 is an explanatory diagram showing the image forming apparatus with its cover open.

FIG. 2 is a diagram showing the outline of an image forming apparatus according to one embodiment of the present invention, FIG. 3 is a cross section of the interior of the image forming apparatus shown in FIG. 2, FIG. 4 is a cross section of a process cartridge shown in FIG. 3, and FIG. 5 is a diagram showing the image forming apparatus with its cover open.

The image forming apparatus illustrated in FIG. 2 is an electrophotographic printer. FIG. 2 is a front perspective view of the apparatus. In FIG. 2, a front cover 10 opens forward relative to the apparatus to provide access to a feeding path 3 shown in FIG. 3. Manipulation of a lock lever 10*a* disengages a cover lock and enables the opening of the front cover 10. A manual inserting guide 10*b*, when opened, serves as a guide for a manually inserted sheet. An upper cover 11, which covers the top of the apparatus, swings upward relative to the apparatus to provide access to the upper interior of the apparatus. A sheet cassette 12 is inserted into the apparatus from the front.

A cassette inserting port 13 is used to insert the sheet cassette 12 into the apparatus. A stacker 14, mounted on the upper surface of the apparatus, receives printed sheets. A sheet guide 15, provided on the stacker 14, aligns sheets discharged to the stacker 14. On an operation panel 16, provided on the front cover 10, are various switches and a display device. A controller box 17, provided at the bottom of the apparatus, accommodates printer control circuits, etc. An exhaust port 18 has an inset exhaust block to permit the escape of fumes and heat from the apparatus.

Referring to the cross section of the apparatus in FIG. 3, an electrophotographic process cartridge 2, which is located above the sheet cassette 12, will be described later while referring to FIG. 4. A thermal fixing unit 6 holds a sheet between a heat roller 60 and a backup roller 61 to fix a toner image on the sheet. The thermal fixing unit 6 includes a cleaning roller 62 that removes toner from the heat roller 60. An optical unit 7 employs a polygon mirror to scan a beam from a semiconductor laser, which is driven in consonance with image information, and writes an image on a photosensitive drum 40. The light image from the optical unit 7 passes above a developing unit 5 (which will be described later while referring to FIG. 4) of the process cartridge 2, as indicated by a broken-line arrow, and irradiates the photosensitive drum 40 of the process cartridge 2. A sheet separator 8 has a discharge electrode that applies to the back surface of a sheet, to which a toner image on the photosensitive drum 40 has been transferred, a charge having an opposite polarity to that of the potential at the back surface of the sheet. The sheet separator 8 employs the discharge electrode to deelectrify the back surface of the sheet and to separate the sheet from the photosensitive drum 40.

A pickup roller 30 picks up a sheet in the sheet cassette 12. A resist roller 31 aligns the leading edge of the picked up sheet and feeds the sheet. A manual inserting port 32 serves as a port for manually inserted sheets. Feeding rollers 33 feed a sheet manually inserted at the manual inserting port 32 to the photosensitive drum 40 of the process cartridge 2. Reference numeral "34" denotes a rotary shaft of the front cover 10. A discharge roller pair 36, located at the top portion of the front cover 10, discharges a sheet, which has passed through the thermal fixing unit 6, to the stacker 14. A manual inserting path 38 forms a junction path that runs from the manual inserting port 32 to where it joins the feeding path 3 at the process cartridge 2.

As shown in the cross section of the process cartridge 2 in FIG. 4, the process cartridge 2 includes a drum cartridge 4 and the developing unit 5. The developing unit 5, which is attached to the drum cartridge 4 by pins (not shown), can be separated from the drum cartridge 4 by removing the pins.

The structure of the drum cartridge 4 will now be explained. In FIG. 4, the photosensitive drum 40 has an organic photosensitive layer (such as OPC) formed on the surface of a cylindrical base of aluminum or the like, and is rotated clockwise, as illustrated. A brush charger 41 is constituted by winding, around the rotary shaft, a conductive brush which has conductive rayon fibers woven into the core. The photosensitive drum 40 receives a uniform charge of about −600 V from the brush charger 41.

A transfer roller 42, included in the drum cartridge 4, is made of a conductive porous rubber material, such as porous polyurethane foam sponge. Following application of a transfer voltage to the transfer roller 42, the roller 42 is pressed against the photosensitive drum 40 and transfers a toner image on the photosensitive drum 40 onto a sheet. A scraping blade 44 attached to a waste toner box (cleaner) 43 removes residual toner from the photosensitive drum 40 and the removed toner is deposited in the waste toner box 43. A handle 45 is used to lift and position the drum cartridge 4 by hand. A roller cover 46 serves as a stopper for the transfer roller 42 and also protects the transfer roller 42.

The arrangement of the developing unit 5 will now be described. In FIG. 4, a developing roller 50 is a conductive elastic roller, which is preferably made of a conductive porous rubber material such as conductive porous polyurethane foam sponge. The developing roller 50 rotates clockwise, as indicated in the diagram, and feeds a non-magnetic, one-component toner to the photosensitive drum 40 while holding the toner with the retentive force of its surface. The developing roller 50 is pressed against the photosensitive drum 40 with a predetermined nip width, and a developing bias voltage of about −300 V is applied to the developing roller 50.

A layer-thickness restricting blade 51, formed of 0.1-mm thick stainless plate, restricts the thickness of the toner layer on the developing roller 50 to a predetermined thickness. The layer-thickness restricting blade 51 is pressed against the developing roller 50, and a negative voltage of about −400 V, for example, is applied to the restricting blade 51. By the application of the voltage, the layer-thickness restricting blade 51 supplies negative charges to the toner to forcibly charge the toner negatively, while restricting the toner layer. The toner can therefore be stably electrified under conditions of high humidity and high temperature. A reset controller 52 is made of conductive sponge. The reset roller 52 faces the developing roller 50 and rotates in the same direction as the developing roller 50. A bias voltage of −400 V is applied to the reset roller 52, which removes toner from the developing roller 50 to the right in the diagram and supplies toner to the developing roller 50 to the left in the diagram.

Paddle rollers 53 and 54 rotate to stir and charge the non-magnetic, one-component toner in the developing unit 5, and feed the stirred toner toward the reset roller 52. A toner cassette retainer 55 retains a toner cassette 56. The toner cassette 56 is detachable from the toner cassette retainer 55.

A toner supply lever 57, provided in the toner cassette 56, rotates and supplies toner in the toner cassette 56 to the developing unit 5. A handle 58 is mounted on the toner cassette 56 for ease of handling the toner cassette 56. Sheet guide ribs 59, together with the roller cover 46, define a path along which a sheet is fed between the photosensitive drum 40 and the transfer roller 42.

The U-shaped feeding path 3 is defined from the sheet cassette 12 via the process cartridge 2 to the discharge roller pair 36.

Processing performed by the printer will now be explained while referring to FIGS. 2 through 4. At the processing start, the pickup roller 30 picks up a sheet from the sheet cassette 12 and feeds it toward the resist roller 31. When the leading edge of the sheet contacts the resist roller 31, the resist roller 31 first aligns and then feeds the sheet along the U-shaped feeding path 3 toward the photosensitive drum 40. Concurrent with the arrival of the leading edge of the sheet at the resist roller 31, the optical unit 7 initiates image scanning of the photosensitive drum 40. Consequently, on the surface of the photosensitive drum 40, which carries a −600 V charge acquired from the charge roller 41, the potential in the areas affected by the scanning falls to zero and an electrostatic latent image, consonant with the projected image, is formed.

Since a bias voltage of −300 V is applied to the developing roller 50 in the developing unit 5, the negatively electrified toner adheres to the zero potential latent image portion of the photosensitive drum 40 and describes a toner image thereon. Then, while a sheet fed by the resist roller 31 is held against the photosensitive drum 40 by the transfer roller 42, electrostatic force, together with pressure exerted by the transfer roller 42, transfers the toner image from the photosensitive drum 40 to the sheet. When the back side of the sheet, which has been electrostatically adsorbed to the photosensitive drum 40, is deelectrified by a charge supplied from the sheet separator 8, the sheet separates from the photosensitive drum 40. The separated sheet is then fed to the thermal fixing unit 6 and the toner image on the sheet is thermally fixed by the heat roller 60 of the thermal fixing unit 6. The image-fixed sheet is discharged by the discharge roller pair 36 to the stacker 14.

In like manner, when a sheet is inserted at the manual inserting port 32, via the previously pulled down manual inserting guide **10*b*, the feeding rollers 33 feed the sheet, along the manual inserting path 38, to the photosensitive drum 40 where electrostatic force, together with pressure exerted by the transfer roller 42, transfers to the sheet the toner image on the photosensitive drum 40. Subsequently, the sheet, which is electrostatically adsorbed to the photosensitive drum 40, is separated from the photosensitive drum 40, by a charge that is supplied from the sheet separator 8, and fed to the thermal fixing unit 6. After the toner image on the sheet is thermally fixed by the heat roller 60 of the thermal fixing unit 6, the sheet is discharged by the discharge roller pair 36 to the stacker 14**.

Referring to FIG. 5, wherein the front cover 10 and the upper cover 11 of the illustrate apparatus are open, the front cover 10 is opened to the front relative to the apparatus (to the right in the diagram), and pivots on the cover rotary shaft 34. Provided on the front cover 10 are the manual inserting guide **10*b*, the manual inserting port 32, the feeding rollers 33, the manual inserting path 38, the sheet separator 8, the thermal fixing unit 6, and the upper discharge (drive) roller 36*a* of the discharge roller pair 36**.

The upper cover 11 is opened from the top relative to the apparatus (upward in the diagram), and pivots on a shaft (not shown). The lower discharge (pinch) roller **36*b* of the discharge roller pair 36 is provided on the upper cover 11**.

As shown in FIG. 5, when the lock lever **10*a* for the front cover 10 is disengaged and the front cover 10 is opened, the U-shaped feeding path 3 that extends from the resist roller 31 to the discharge roller pair 36** is exposed and a jammed sheet can be easily removed.

If the transfer roller 42 is so shifted that its position relative to the photosensitive drum 40 is no longer exactly parallel, image transfer cannot be performed properly. The transfer roller 42, therefore, is provided on the side of the process cartridge 2. And although in this design a space cannot be provided between the photosensitive drum 40 and the transfer roller 42 by altering their relative positions, this does not hinder the removal of a jammed sheet.

The entire thermal fixing unit 6 is provided on the front cover 10, for were the thermal fixing unit 6 composed of separable parts, so as to expose the feeding path 3, one part of the thermal fixing unit 6 would have to be mounted on the process cartridge 2. This would make it difficult to pull out the process cartridge 2. Although in this design the relative positions of the heat roller 60 and the backup roller 61 in the thermal fixing unit 6 cannot be altered to provide a space between them, it does not affect the removal of a jammed sheet.

As shown in FIG. 3, the front cover 10 overlaps and secures the upper cover 11 at the sheet discharging portion, and free movement of the upper cover 11 is not possible until the front cover 10 is opened. Thus, as illustrated in FIG. 5, when the front cover 10 is opened the upper cover 11 may also be opened to expose the top and part of the front of the apparatus. Accordingly, when exchanging toner cassettes 56, the old toner cassette 56 can easily be removed and a new one installed, at the front of the apparatus, while the process cartridge 2 is retained in the apparatus.

Further, since the front of the apparatus is exposed by opening the front cover 10, and the top of the apparatus is exposed by opening the upper cover 11, removal and attachment of the process cartridge 2 is also easy. Even if the process cartridge 2 is large, its exchange is easy. Thus, the size of the entire process cartridge 2, and especially the size of the developing unit 5 in the process cartridge 2, can be increased. And as the quantity of the retainable developer can also be increased, the exchanging cycle for the developing unit 5 can be extended.

Also, since the developer can be supplemented by replacing only the toner cassette 56, the exchanging cycle of the developing unit 5 can be further extended. And again, as the discharge rollers 36 are separately provided on the covers 10 and 11, respectively, when the covers 10 and 11 are opened the entire U-shaped feeding path 3 is exposed and removal of a jammed sheet is easy.

Figure 6A:
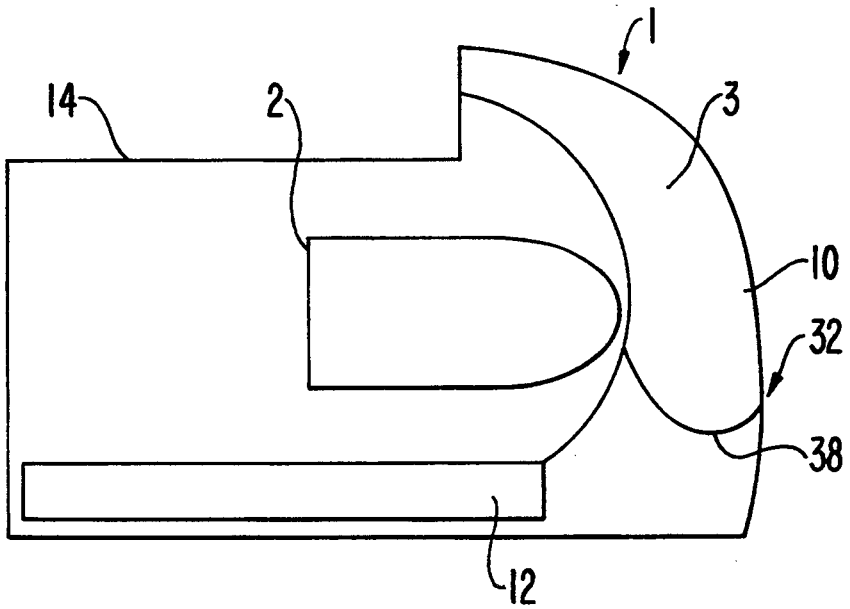
FIGS. 6A and 6B are diagrams showing a sheet inverting unit attached to the image forming apparatus shown in FIG. 2.
Figure 6B:
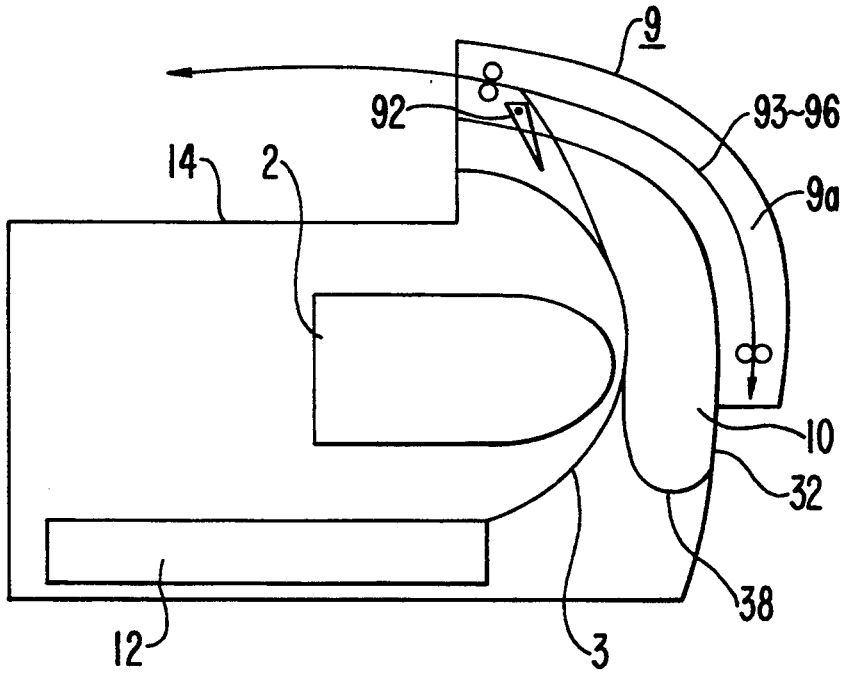

FIGS. 6A and 6B are diagrams for explaining the principle of the present invention. As shown in FIG. 6B, a sheet inverting unit 9 is attached to the above described printer 1 illustrated in FIG. 6A. The sheet inverting unit 9 is mounted on the front cover 10 of the printer 1. As shown in FIG. 6B, the sheet inverting unit 9 basically includes a guide path 9*a*, which extends from the top of the printer 1 along the front cover 10, to the manual inserting port 32 and a switching lever 92. In double-side printing mode, a sheet on which an image is printed by the process cartridge 2 is fed by the switching lever 92 to the sheet inverting unit 9. The sheet inverting unit 9 feeds the guided sheet toward the stacker 14, and then switches back to feed the sheet to the manual inserting port 32 along the guide path 9*a*. As a result, the sheet passes along the manual inserting path 38 of the printer 1 and is fed to the process cartridge 2, and image printing is performed on the reverse of the sheet. The double-side printed sheet is discharged along the feeding path 3 to the stacker 14.

Figure 7:
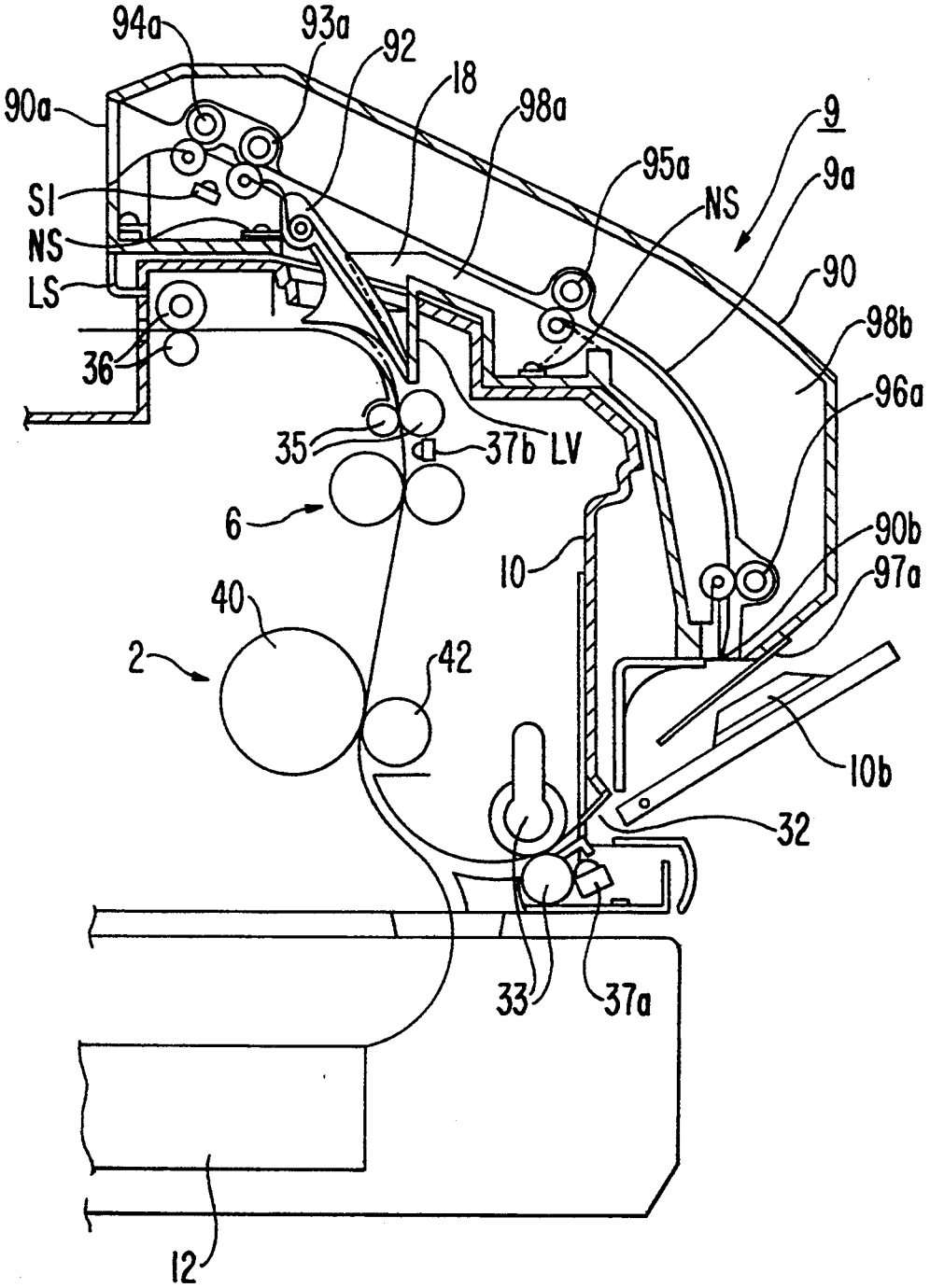
FIG. 7 is a cross sectional view of the sheet inverting unit when it is mounted on the image forming apparatus shown in FIG. 6B.
Figure 8:
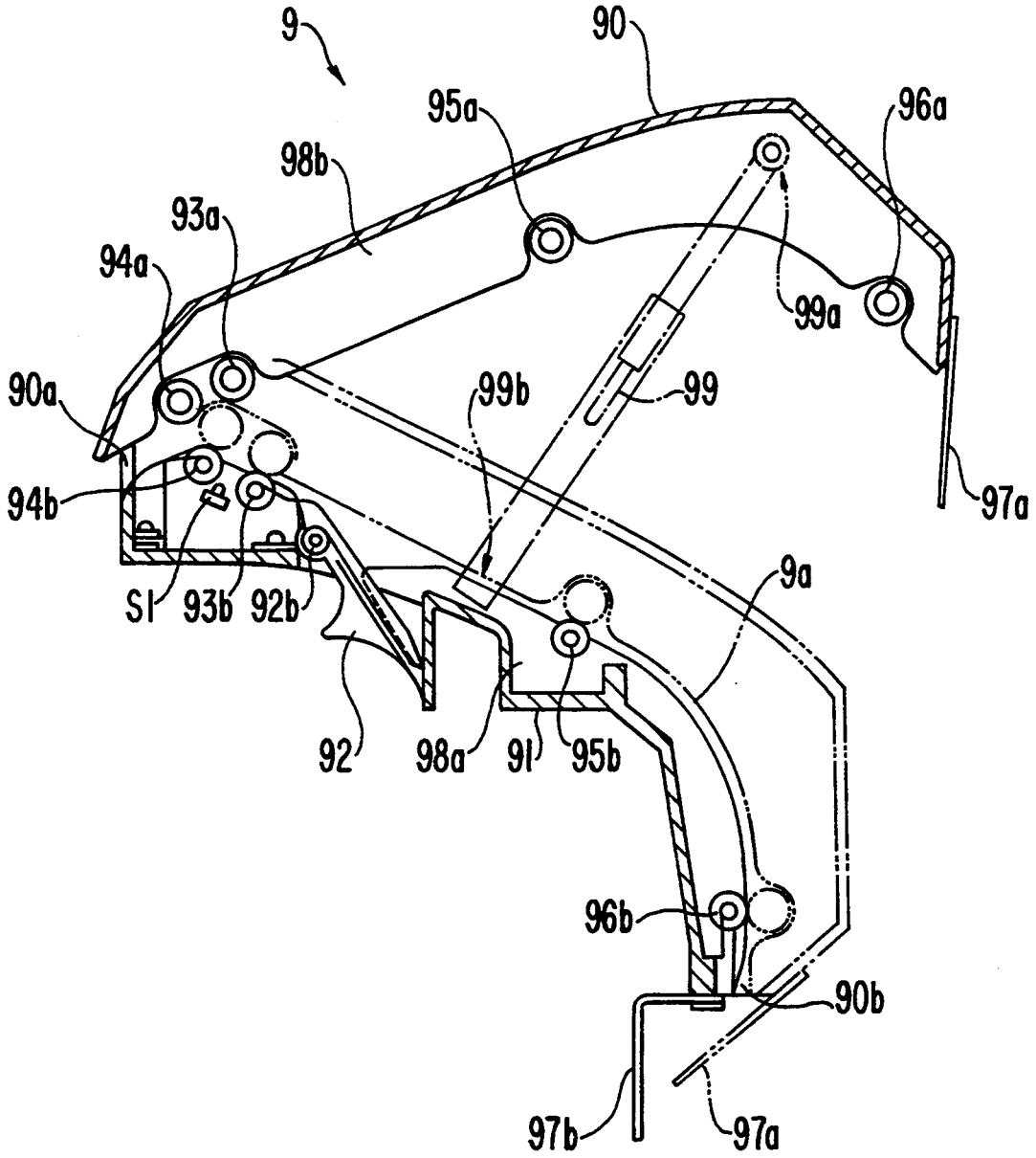
FIG. 8 is a cross sectional view showing the sheet inverting unit shown in FIG. 7.

The sheet inverting unit 9 will now be explained in more detail. FIG. 7 is a cross section of the sheet inverting unit when attached to the printer, and FIG. 8 is a cross section of the arrangement of the sheet inverting unit 9.

As illustrated in FIG. 7, a sensor 37*a* that detects manual sheet insertion is located at the manual inserting port 32 of the printer 1. Provided at its rear stage are feeding rollers 33 that perform resist operation to align the leading edge of the sheet inserted at the manual inserting port 32 and to synchronize the feeding of that sheet with the rotation of the photosensitive drum 40. A sensor 37*b* that detects the passing of the sheet is provided between the thermal fixing unit 6 and feeding rollers 35, which are located at the rear stage of the sensor 37*b*.

The sheet inverting unit 9 includes a base plate 91 and a top cover 90, as shown in FIG. 7. The top cover 90 is provided pivotable at a rotary shaft (not shown) with respect to the base plate 91. The top cover 90 and the base plate 91 are connected by an open/close cylinder 99. When the top cover 90 is opened, the guide path 9*a* is accordingly exposed, which facilitates the removal of a jammed sheet.

As illustrated in FIG. 7, the base plate 91 is formed to match the shape of the front cover 10 of the printer 1. A metal fitting LS is provided at the left end of the base plate 91. The metal fitting LS engages the discharge port of the front cover 10 (the upper portion of the discharge rollers 36 in FIG. 7), and is secured at the left end of the front cover 10.

A positioning rib LV is located almost in the center of the base plate 91. The positioning rib LV is inserted into the exhaust port 18 of the front cover 10 to ensure correct positioning of the base plate 91 on the front cover 10. Although an exhaust block is provided in the exhaust port 18, as shown in FIG. 2, by removing the exhaust block from the exhaust port 18 the positioning rib LV can be positioned in the exhaust port 18 in the front cover 10. The exhaust port 18, from which the exhaust block is removed, serves as an exit to the sheet inverting unit 9.

Further, the base plate 91 is secured to the front cover 10 by fitting screws NS at the mounting position for the operation panel 16 of the front cover 10 and at the position above the discharge rollers 36. In other words, the sheet inverting unit 9 can be detached from the printer 1 and attached thereto by the screws NS. The manual inserting guide 10*b* provided on the front cover 10 is opened before the sheet inverting unit 9 is attached to the front cover 10.

The switching lever 92 of the sheet inverting unit 9 is positioned to enter the exhaust port 18 of the printer 1. The switching lever 92 is supported rotatable on the frame (not shown) of the sheet inverting unit 9 by a shaft 92*b*. Referring to FIG. 7, normally the switching lever 92 uses its guide portion 92*a* (which will be described later while referring to FIG. 10) to guide a sheet from the feeding rollers 35 toward the discharge rollers 36, but when the switching lever 92 is rotated clockwise at the shaft 92*b*, its distal end enters the feeding path 3 and the sheet fed from the feeding rollers 35 is guided through the exhaust port 18 into the sheet inverting unit 9. Through this process, the sheet feeding route can be changed.

Provided in the sheet inverting unit 9 are switchback roller pairs 93*a* and 93*b*, and 94*a* and 94*b*, which hold and feed the sheet that has been fed via the switching lever 92 to the sheet inverting unit 9. The rollers on the upper side, 93*a* and 94*a*, are drive rollers, and the rollers on the lower side, 93*b* and 94*b*, are pinch rollers.

A switchback window 90*a* is formed in the base plate 91 in the vicinity of the switchback roller pair 94*a* and 94*b*. The switchback window 90*a* is employed for the feeding of a sheet, which is guided to the sheet inverting unit 9, out and above the stacker 14 by the switchback roller pairs 93 and 94. The sheet that protrudes from the switchback window 90*a* is gripped and held by the switchback roller pair 94, and then inversely fed by the switchback roller pairs 93 and 94 along the guide path 9*a*.

A sensor S1 that detects the leading edge of the sheet to be fed is provided between the switchback roller pairs 93 and 94 to control feeding direction inversion. The sheet inverting unit 9 has feeding rollers 95 and 96 that feed the sheet, which is inversely fed by the switchback roller pairs 93 and 94, toward an exit port 90*b*.

As illustrated in FIG. 8, a pair of sheet guides 97*a* and 97*b* are formed at the exit port 90*b* of the sheet inverting unit 9. The sheet guides 97*a* and 97*b* guide a sheet that has been conveyed to the exit port 90*b* so that the leading edge of the sheet enters the manual inserting port 32 via the manual inserting guide 10*b*. It should be noted that the sheet is inverted with its printed surface to the right in the diagram and its unprinted surface to the left.

The base plate 91 and the top cover 90 have respectively a base guide rib (internal guide) 98*a* and a top cover guide rib (external guide) 98*b*. The guide ribs 98*a* and 98*b* define the guide path 9*a* and stably guide sheets that have a variety of widths.

Figure 9:
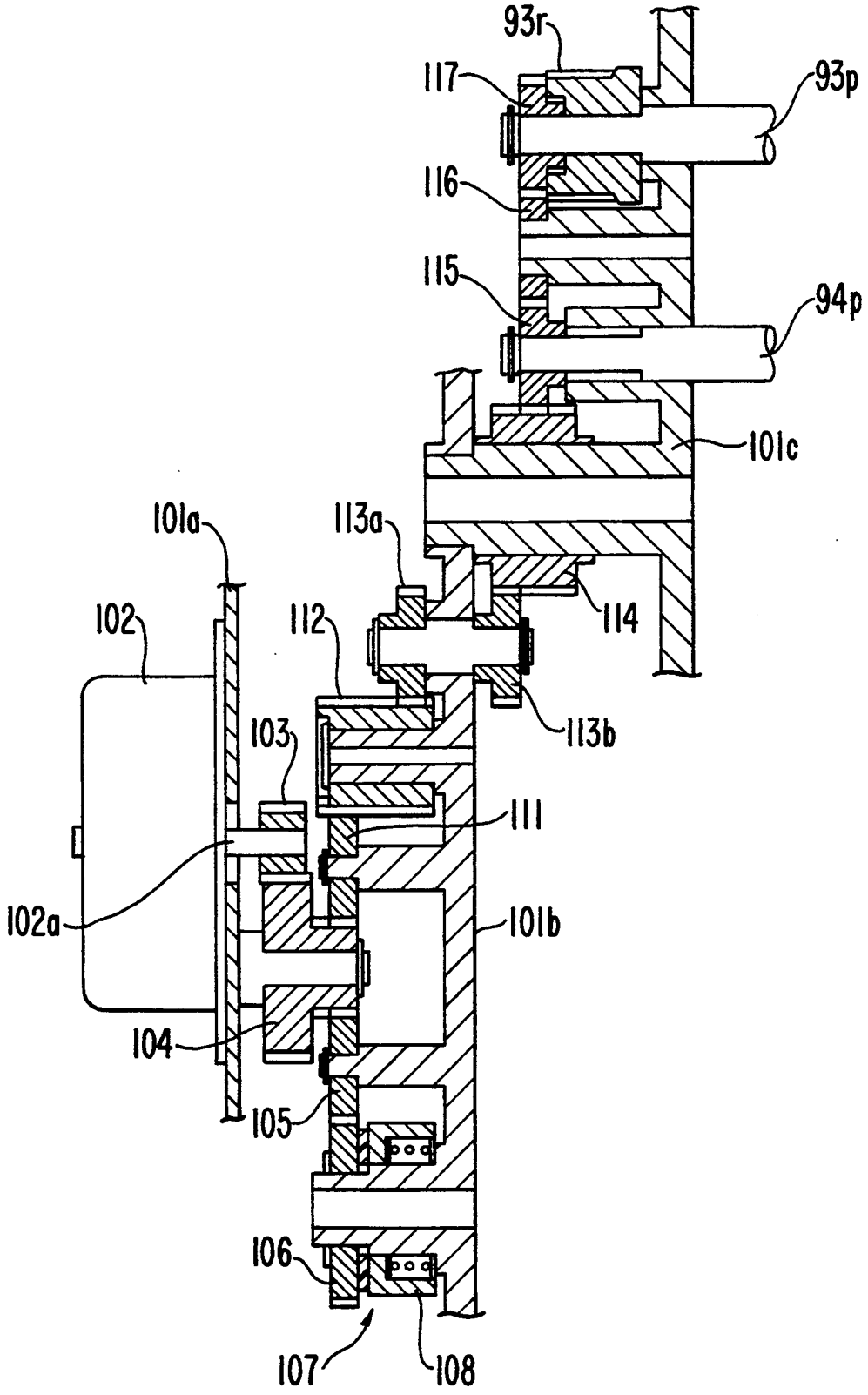
FIG. 9 is a top cross section of a drive mechanism of the sheet inverting unit shown in FIG. 7.

The drive system of the sheet inverting unit 9 will now be described while referring to FIGS. 9 and 10. In FIG. 9, a drive motor 102 is provided on a frame 101*a* of the sheet inverting unit 9. A motor gear 103, which is fitted around a drive shaft 102*a* of the drive motor 102, engages a reduction gear 104, which is attached to the frame 101*a*.

The reduction gear 104 engages gears 105 and 111, which are provided in a second frame 101*b* of the sheet inverting unit 9. The gear 105 engages a gear 106 (see FIG. 10) that is attached to the frame 101*b* and has a torque limiter 107. A cam 108 is provided in the torque limiter 107. The counterclockwise revolution of the cam 108 shown in FIG. 10 is limited by the torque limiter 107, and the clockwise revolution of the cam 108 is restricted by a stopper 110 shown in FIG. 10.

Figure 10:
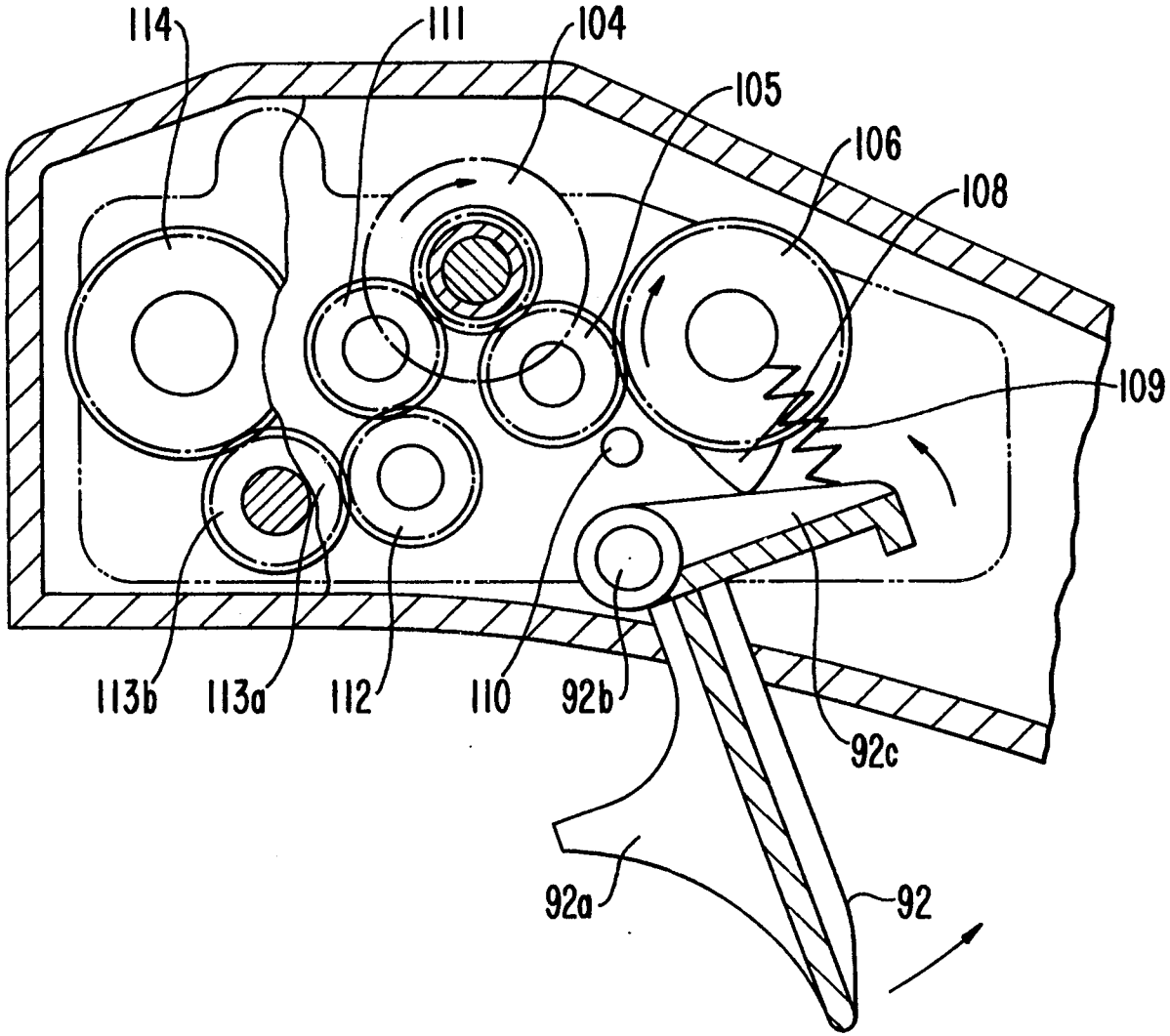
FIG. 10 is a vertical cross section of the drive mechanism of the sheet inverting unit shown in FIG. 7.

The switching lever 92 has a sheet guide portion 92*a* and an arm 92*c*, as illustrated in FIG. 10. The cam 108 engages the upper surface of the arm 92*c*, and a tension spring 109 is located at the distal end of the arm 92*c*. The switching lever 92 is constantly impelled counterclockwise at the rotary shaft 92*b* by the tension spring 109. In FIG. 10, wherein the switching lever 92 is positioned to guide a sheet to the sheet inverting unit 9, when the gear 106 rotates clockwise, as indicated by the arrow, the switching lever 92 is rotated, in a direction indicated by the arrow, by the tensile force of the tension spring 109. The switching lever 92 is then positioned to guide a sheet toward the discharge rollers 36 by the back of the sheet guide 92*a*, as shown in FIG. 7. This position is the initial position of the switching lever 92.

Referring again to FIG. 9, a gear 111 engages an idler gear 112. The idler gear 112 engages a gear 113*a* provided in the frame 101*b*. A gear 113*b* is fitted around the same shaft that the gear 113*a* is fitted around. The gear 113*b* engages a gear 114 that is provided in a third frame 101*c* of the sheet inverting unit 9.

The gear 114 engages a gear 115 that is fitted over a rotary shaft 94*p* of the switchback roller 94*a* shown in FIGS. 7 and 8. The gear 115 engages an idler gear 116 that is provided in the frame 101*c*, and the idler gear 116 engages a gear 117 that is fitted around a rotary shaft 93*p* of the switchback roller 93*a* illustrated in FIGS. 7 and 8. As a result, the rotary shaft 93*p* and 94*p* rotate in the same direction, as also do the switchback rollers 93*a* and 94*a*. Further, fitted around the rotary shaft 93*p* is a toothed pulley 93*r* that is used to transmit power to the feeding rollers 95 and 96 that will be described later.

The function of the drive system of the sheet inverting unit 9 will now be described while referring to FIGS. 9 and 10. When the reduction gear 104 is rotated clockwise, as indicated by an arrow in FIG. 10, by the drive motor 102, the gear 106 also rotates clockwise, as indicated by an arrow. Since the cam 108, therefore, also rotates clockwise, the switching lever 92 is disengaged from the cam 108. The switching lever 92 is pivoted counterclockwise, as indicated by an arrow, by the impelling force of the tension spring 109, and is set to its initial state, shown in FIG. 7, for guiding a sheet toward the discharge rollers 36. When the cam 108 reaches the stopper 110, the rotation of the cam 108 is halted by the stopper 110.

At this time, the switchback roller pairs 93 and 94 shown in FIGS. 7 and 8 are rotated counterclockwise via the gear train 112 through 117, and are prepared to feed the sheet toward the exit port 90*b*.

When the reduction gear 104 is rotated counterclockwise by the drive motor 102, as viewed in FIG. 10, the gear 106 rotates counterclockwise, i.e., in the direction opposite to that indicated by the arrow. Accordingly, the cam 108 rotates counterclockwise, and depresses the switching lever 92. The cam 108, therefore, counters the impelling force of the tension spring 109, and pivots the switching lever 92 counterclockwise, i.e., the direction opposite to that indicated by the arrow. As a result, the switching lever 92 is positioned for double-side printing, as shown in FIG. 10, for guiding a sheet to the sheet inverting unit 9. The cam 108 is halted at the proper position by the torque limiter 107.

The switchback roller pairs 93 and 94 shown in FIGS. 7 and 8 are rotated clockwise via the gear train 112 through 117, and are set ready to feed a sheet to the switchback window 90*a*. The motor 102 is controlled by a sheet detection signal emitted by the sensor S1.

Figure 11:
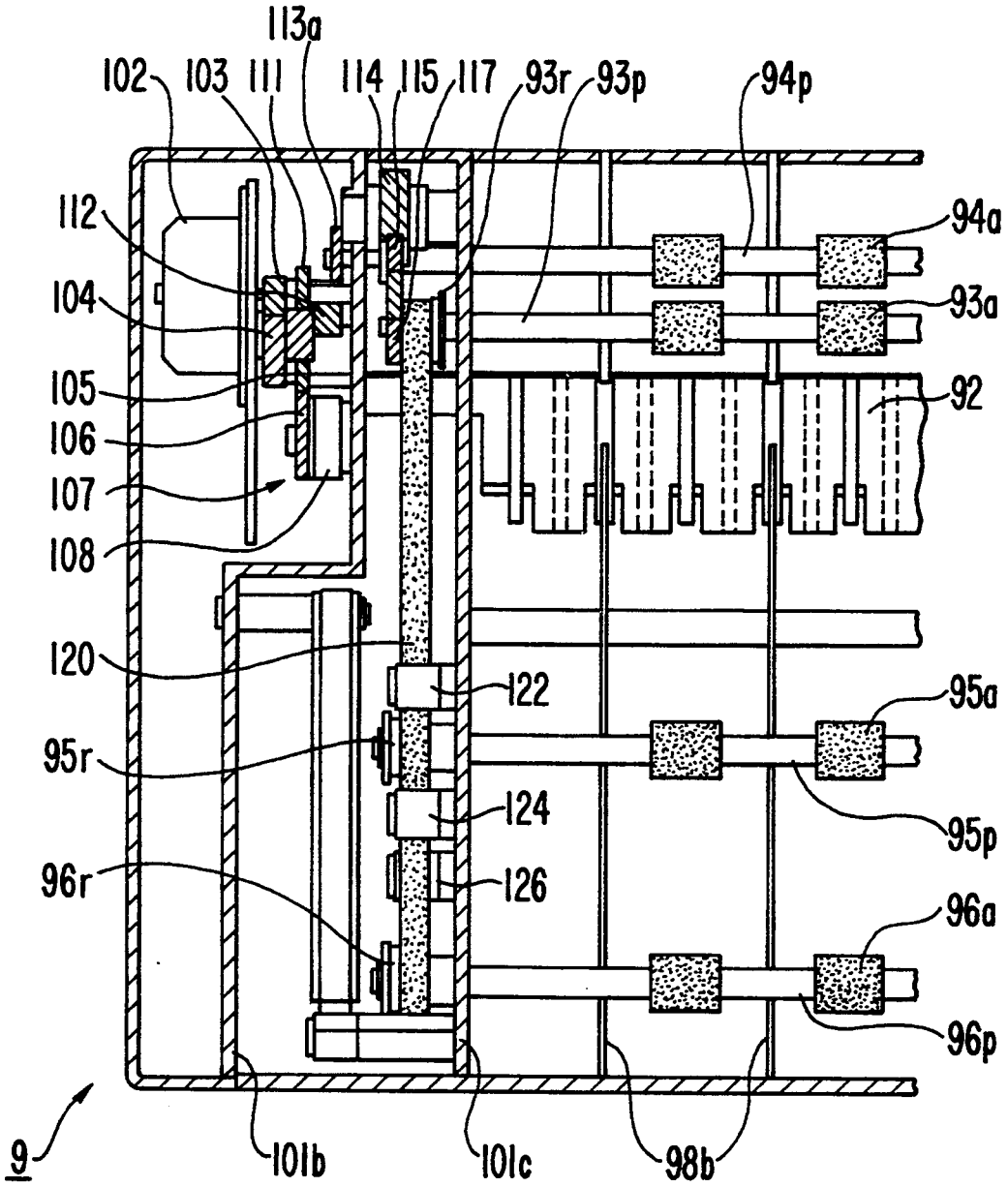
FIG. 11 is a front view of the drive system of the sheet inverting unit shown in FIG. 7.
Figure 12:
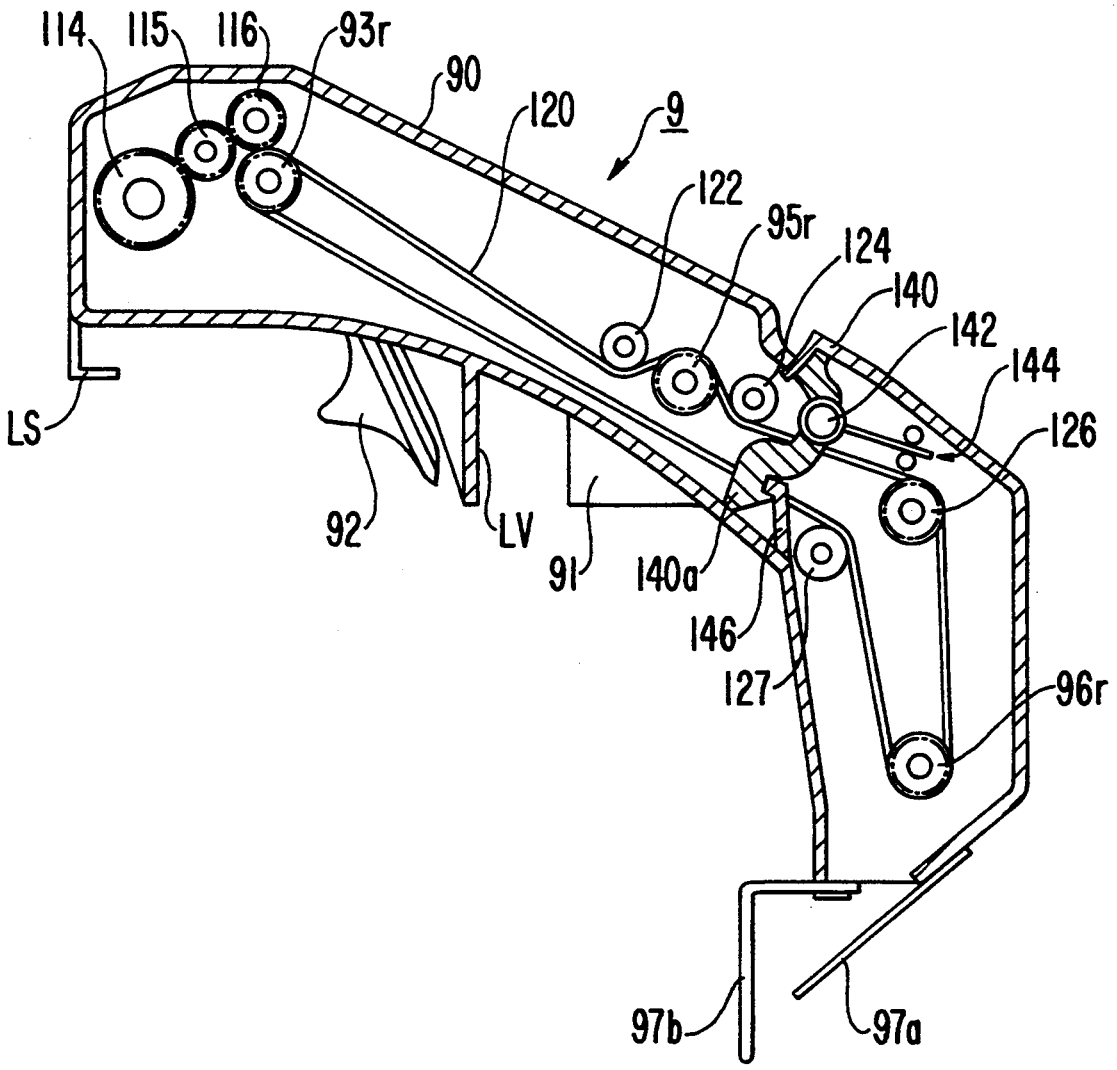
FIG. 12 is a cross sectional view of the drive system of the sheet inverting unit shown in FIG. 7.

FIGS. 11 and 12 are respectively a top view and a side view of the drive system of the sheet inverting unit 9. As illustrated in FIGS. 11 and 12, the toothed pulley 93*r*, together with the gear 117, is fitted around the rotary shaft 93*p* of the switchback roller 93*a*. Similarly, toothed pulleys 95*r* and 96*r* are respectively fitted around rotary shafts 95*p* and 96*p* of the feeding rollers 95*a* and 96*a* shown in FIGS. 7 and 8. A toothed belt 120 is fitted around the toothed pulleys 93*r*, 95*r*, and 96*r*. Pressure rollers 122 and 124 press the toothed belt 120 against the toothed pulley 95*r* at the rotary shaft 95*p*. The rotary shafts 95*p* and 96*p* therefore rotate in unison with, and in the same direction as the rotary shaft 93*p*, as also do the rollers 94*a*, 93*a*, 95*a*, and 96*a*.

As illustrated in FIG. 12, on the top cover 90, a lock lever 140 is provided pivotable at a rotary shaft 142. The lock lever 140 is forced clockwise by a spring 144, and has a lock pawl 140*a* at its distal end. A stop block 146 is provided on the base plate 91 to engage the lock pawl 140*a*.

When the top cover 90 is closed, as shown in FIG. 12, the lock pawl 140*a* of the lock lever 140 engages the stop block 146 of the base plate 91. To open the top cover 90, an operator inserts his finger into a gap between the top cover 90 and the end of the lock lever 140 and rotates the lock lever 140 clockwise against the force of the spring 144. The lock pawl 140*a* of the lock lever 140 is then disengaged from the stop block 146 of the base plate 91, and the top cover 90 is opened by the driving force of the open/close cylinder 99, as shown in FIG. 8.

To close the top cover, the top cover 90 is pushed to the base plate against the driving force of the open/close cylinder 99, and the lock pawl 140*a* of the lock lever 140 engages the stop block 146 of the base plate and secures the top cover 90 to the base plate 91.

The procedure for attaching the thus structured sheet inverting unit 9 to the printer 1 will now be explained. First, before attaching the sheet inverting unit 9 to the printer 1, the exhaust block in the exhaust port 18 in the front cover 10 of the printer 1 and the operation panel 16 are removed. Next, as shown in FIG. 7, the sheet inverting unit 9 is mounted on the front cover 10, and the metal fitting LS is fitted to the discharge portion on the left end of the front cover 10. The switching lever 92 and the rib LV are inserted into the exhaust port 18 of the front cover 10. Then, the sheet inverting unit 9 is secured to the front cover 10 by the metal screws NS at the location of the operation panel 16, etc.

The operation panel 16, mounted on the top cover 90 of the sheet inverting unit 9, is electrically connected to the printer 1 by a cable (not shown). This installation can either be done at the factory, before delivery, or by a service man when he delivers the sheet inverting unit 9 to a user who owns a single-side printer 1, and installs the unit 9 on the printer 1. In this way, when a user wants to do double-side printing with a single-side printer 1, the printer 1 can perform double-side printing merely with the sheet inverting unit 9 mounted thereon.

Figure 13:
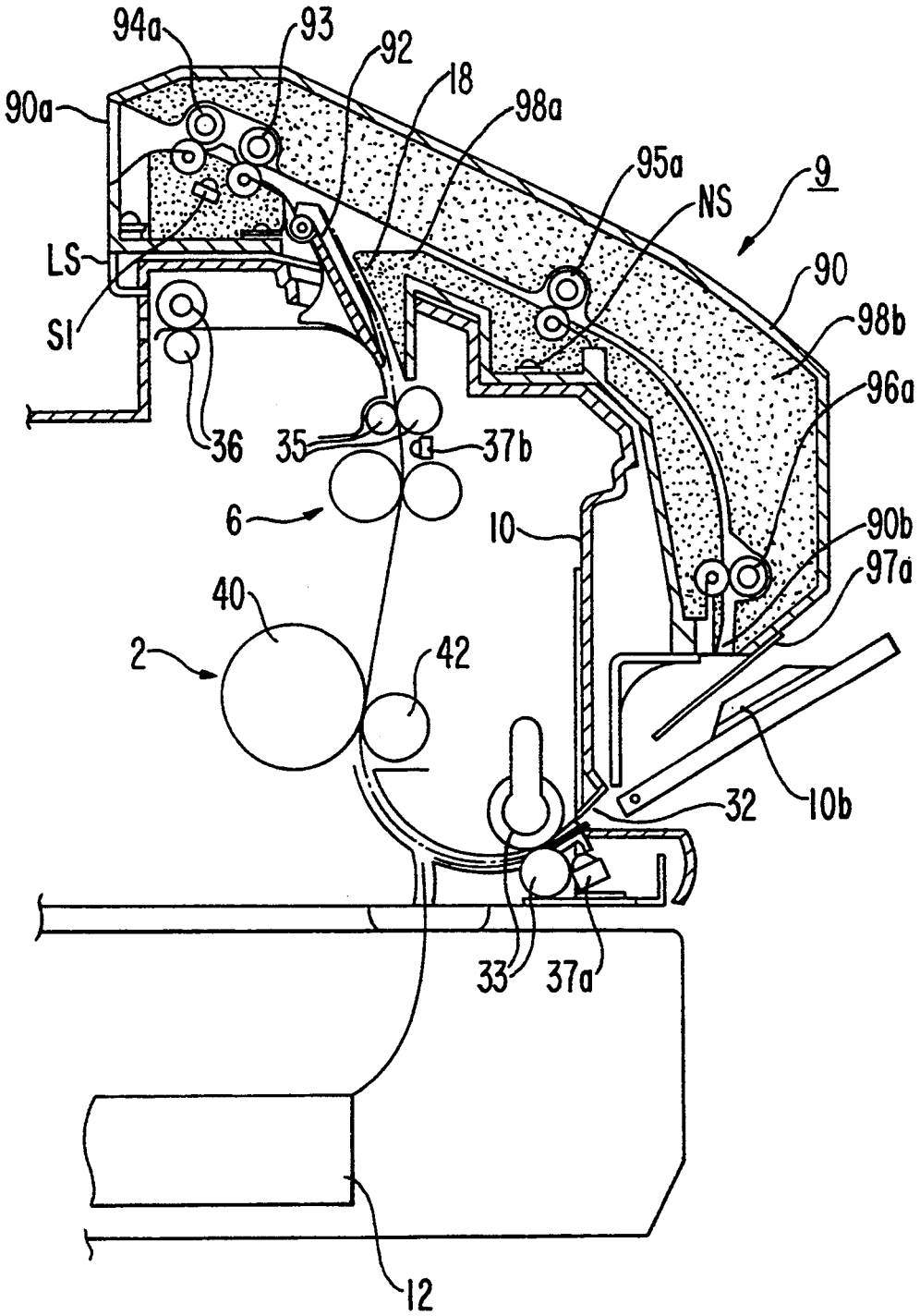
FIG. 13 is a diagram for explaining a sheet inverting process for double-side image forming.
Figure 14:
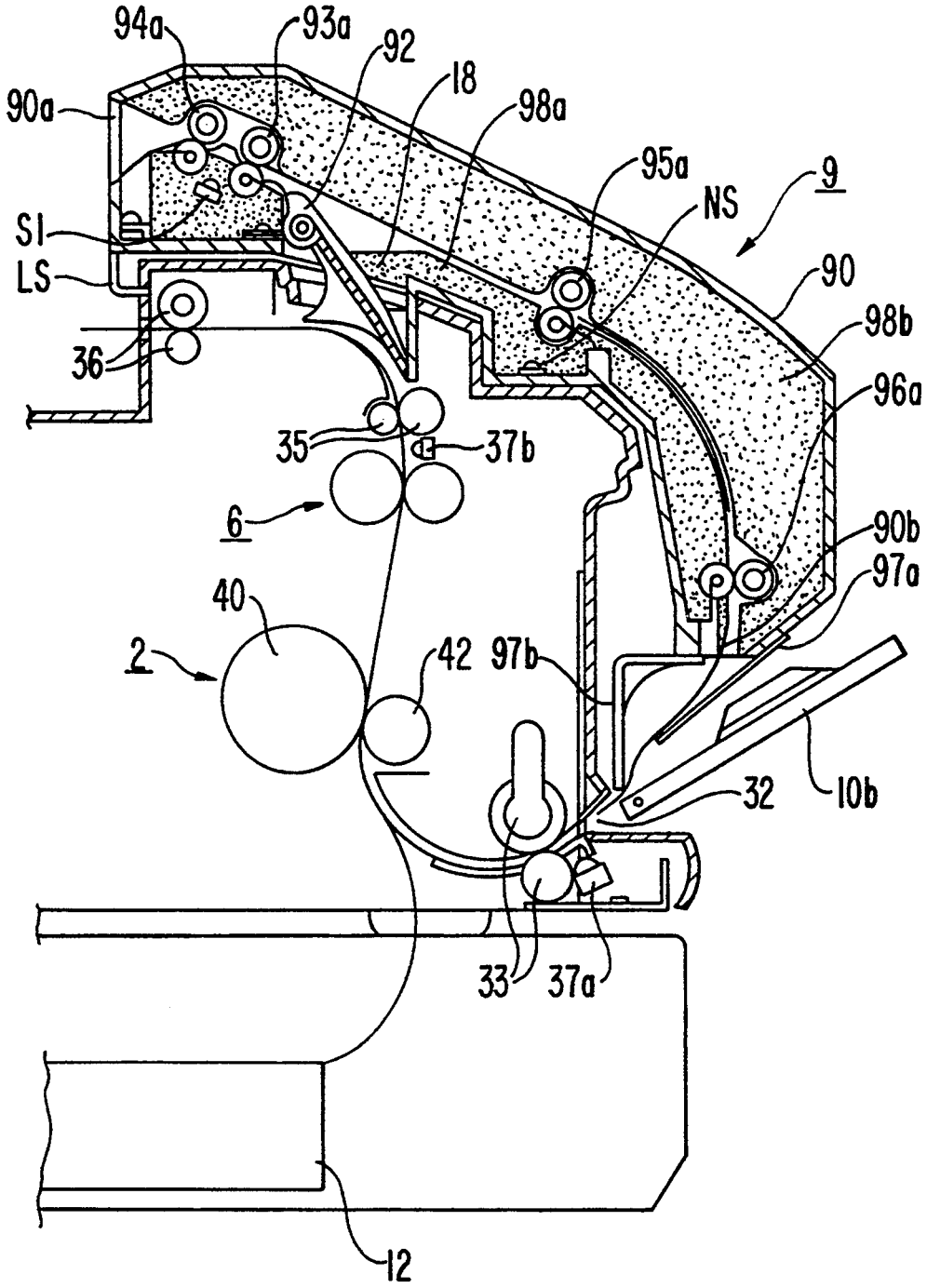
FIG. 14 is a diagram for explaining a sheet re-inserting process for double-side image forming.

Double-side printing will now be described. FIG. 13 is a diagram for explaining how a sheet with an image on one surface is guided to the sheet inverting unit 9; and FIG. 14 is a diagram for explaining how a sheet is inverted and fed to the manual inserting port 32.

In single-side printing mode, a control signal is not transmitted from the printer 1 to the sheet inverting unit 9. As shown in FIG. 7, therefore, the switching lever 92 is in its initial state. An image is printed on one surface of a sheet, supplied from the sheet cassette 12 or inverted via the manual inserting guide **10*b*, by the process cartridge 2, as described when referring to FIGS. 2 through 4. The sheet is thermally heated by the thermal fixing unit 6, fed by the feeding rollers 35, and guided to the discharge rollers 36 along the guide portion 92*a* of the switching lever 92. Finally, the sheet is ejected by the discharge rollers 36 to the stacker 14**.

When double-side printing is instructed by a connected apparatus, such as a computer or a word processor, the controller 17 of the printer 1 selects double-side printing mode and executes the following processing.

(1) A sheet is extracted from the sheet cassette 12 and moved forward until it contacts the resist roller 31. When the forward edge of the sheet contacts the engagement portion of the resist roller 31, the sheet is flexed and aligned. Then, the resist roller 31 rotates and feeds the sheet to the process cartridge 2. In a like manner, a sheet inserted into the manual inserting port 32, via the manual inserting guide **10*b*, is detected by the sensor 37*a*, and when the forward edge of the sheet contacts the engagement portion of the feeding rollers 33, the sheet is flexed and aligned. After a predetermined time has elapsed following the detection of the sheet by the sensor 37*a*, the feeding rollers 33 rotate and feed the sheet along the manual inserting path 38 to the process cartridge 2**.

(2) The process cartridge 2 transfers a toner image to one surface of the fed sheet, and feeds the image-bearing sheet to the thermal fixing unit 6 where the toner image on the sheet is thermally fixed. The resultant sheet is fed to the feeding rollers 35, and the sensor **37*b* detects the leading edge of the sheet. Then, the controller 17 of the printer 1 instructs the drive motor 102 of the sheet inverting unit 9 to commence the forward rotation (counterclockwise, i.e., in the direction opposite to that shown in FIG. 10**).

(3) Upon this instruction, the drive motor 102 revolves forward (counterclockwise, i.e., in the direction opposite to that shown in FIG. 10) and rotates the reduction gear 104 counterclockwise, i.e., in the direction opposite to that as indicated in FIG. 10. The gear 106 rotates counterclockwise, and the switching lever 92 pivots clockwise at the rotary shaft **92*b*. As a result, the switching lever 92 moves into the position to guide a sheet into the sheet inverting unit 9, as shown in FIG. 13**.

Also, by rotating the reduction gear 104 counterclockwise, the switchback roller pairs 93 and 94 are rotated clockwise via the gear train 111 through 117, as shown in FIGS. 9 through 12. As a result, the sheet, after being fed by the feeding rollers 35, is guided to the sheet inverting unit 9 by the switching lever 92, as shown in FIG. 13. The sheet is fed further by the switchback roller pairs 93 and 94 until it protrudes from the switchback window **90*a* at the stacker 14. As the printed sheet is guided into the sheet inverting unit 9, the rear edge of the printed sheet is detected by the sensor 37*b*. When a predetermined time has elapsed following the detection of the rear edge of the printed sheet by the sensor 37*b*, the drive system for sheet feeding of the printer 1** is halted.

(4) When the sensor S1 detects the rear edge of the sheet that protrudes from the switchback window **90*a*, the rear edge of the sheet is held by the switchback roller pair 94. In response to that detection by the sensor S1, the controller 17 of the printer 1 instructs the drive motor 102 of the sheet inverting unit 9 to commence reverse rotation (clockwise rotation). Upon receipt of the instruction, the drive motor 102 revolves reversely (clockwise viewed in FIG. 10) and rotates the reduction gear 104 clockwise, as shown in FIG. 10. As a result, the switchback roller pairs 93 and 94 are rotated counterclockwise via the gear train 111 through 117, as shown in FIGS. 9 through 12, and feed the sheet, with its rear edge forward, toward the guide path 90*b* that is defined by the upper guide rib 98*b* and the lower guide rib 98*a***.

Concurrently, the gear 106 is rotated clockwise so that the switching lever 92 pivots counterclockwise at the rotary shaft **92*b* and returns to its initial position, as shown in FIG. 14. The feeding rollers 95 and 96, which are connected to the switchback roller pair 93 by a belt, rotate counterclockwise, and feed the sheet toward the exit port 90*b*. After the sheet is fed through the exit port 90*b*, the guide pair, 97*a* and 97*b*, guide it to the manual inserting guide 10*b* and through the manual inserting port 32 until the forward edge of the sheet contacts the feeding rollers 33**.

(5) Then, in the same manner as in step (1), the feeding rollers 33 are rotated and the sheet is fed along the manual inserting path 38 toward the process cartridge 2. The process cartridge 2 transfers a toner image to the reverse surface of the fed sheet and feeds the image-bearing sheet to the thermal fixing unit 6, as described above. The sheet is thermally fixed by the thermal fixing unit 6, and the resultant sheet is fed toward the feeding rollers 35. When the sensor **37*b* detects the leading edge of the sheet at this time, the controller 17 of the printer 1 does not instruct the drive motor 102 of the sheet inverting unit 9 to commence forward rotation, and thus the switching lever 92 remains at its initial position. The sheet is therefore guided to the back portion of the sheet guide 92c of the switching lever 92, fed toward the discharge rollers 36, and discharged to the stacker 14 by the discharge rollers 36**. The procedures for double-side printing mode are thus terminated.

Since, as described above, a switchback route is positioned above the stacker 14 of the printer 1, the switchback route is situated over and within the horizontal area of the printer 1 and the size of the printer 1 need not be increased to accommodate the switchback route. Also, since the guide path 90a is formed along the front cover 10, the guide path can be shortened and processing speed thereby increased. Further, as the sheet inverting unit 9 does not require a resist roller, etc., the sheet inverting unit 9 can be compactly constructed and manufactured at a low cost.

As the exhaust port 18 of the printer 1 is employed as a guide path to the sheet inverting unit 9 and the manual inserting port 32 is employed as a sheet refeeding port, the printer 1 does not require any special mechanism for double-side printing. No extra component need to be added to the structure of the single-side printer 1, and the printer 1 can be provided at a lower cost.

The feeding path 3 can be exposed by opening the front cover 10 to which the sheet inverting unit 9 is attached. This facilitates maintenance of the apparatus, such as removal of a jammed sheet, replacement of the process cartridge 2, etc. Since the feeding path of the sheet inverting unit 9 can also be opened, a jammed sheet in the sheet inverting unit 9 can easily be removed.

Since the sheet inverting unit 9 is designed detachable to the printer 1, a single-side printer with the sheet inverting unit 9 attached thereto can perform double-side printing. Thus, there is no need to produce a special printer for double-side printing, and a single printer model can be utilized to manufacture single-side printers and double-side printers, ensuring that cost is reduced by mass production.

Further, since the feeding mechanisms 93 through 96, and the switching lever 92 of the sheet inverting unit 9 are driven by a single drive source 100, a compact sheet inverting unit 9 having a simple structure can be provided at a lower cost.

Figure 15:
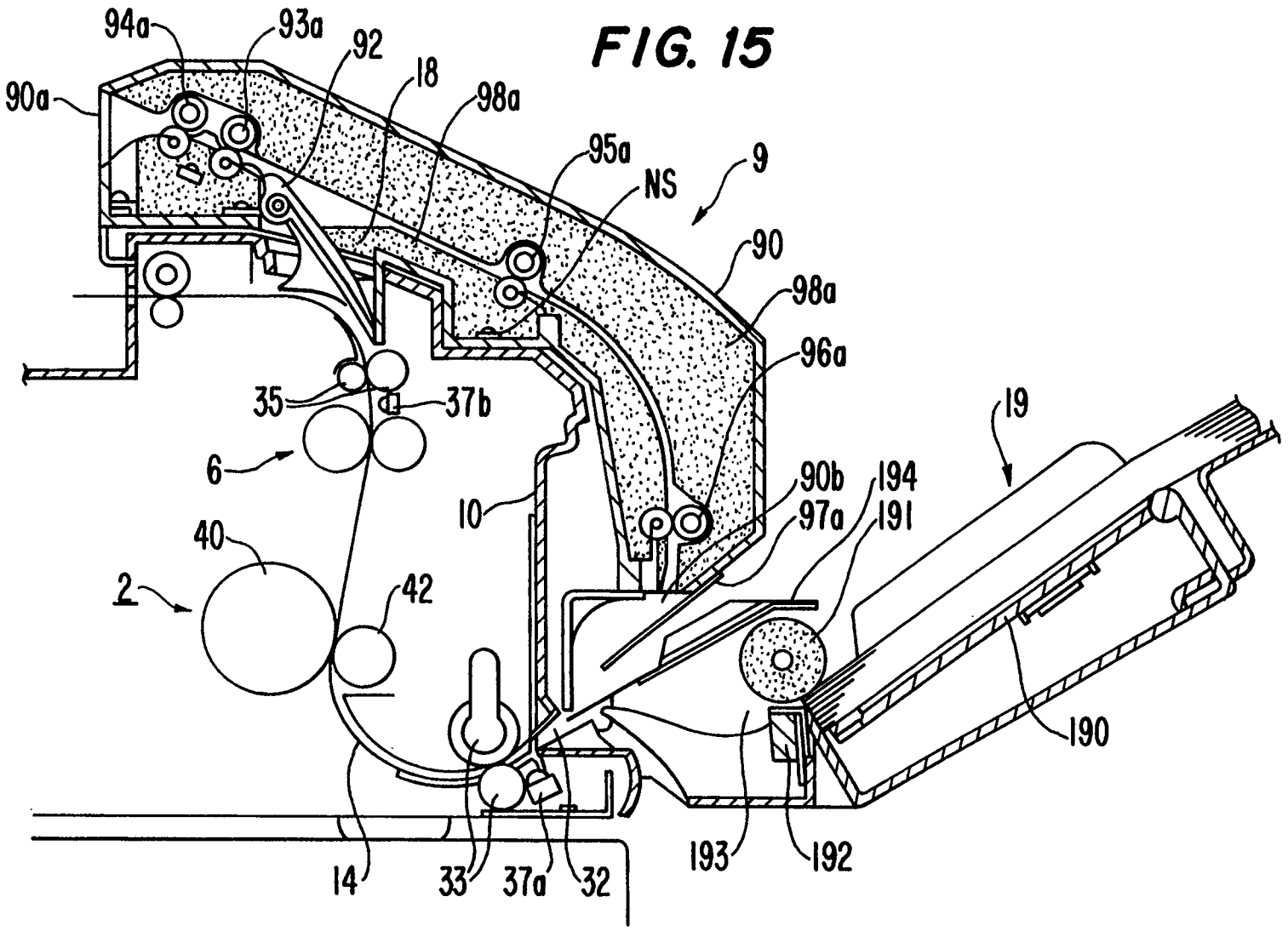
FIG. 15 is a diagram for explaining double-side image forming process by an image forming apparatus that has an attached multi-function feeder.

Double-side printing is also possible when a multi-function feeder is attached to the printer 1. FIG. 15 is a diagram showing a printer 1, with an installed sheet inverting unit 9 that has a multi-function feeder mounted on it.

The same reference numerals are used to denote the components in FIG. 15 that correspond to, or are identical with those in FIGS. 2 through 14. A multi-function feeder 19 employs a separation member 192 and a separating roller 191 to remove a sheet from a hopper 190, and feeds the sheet to the manual inserting port 32 via a guide 193. A manual inserting guide 194 for a multi-function feeder is provided.

The multi-function feeder 19 is mounted on the printer 1 after the manual inserting guide 10b of the printer 1 is removed. The multi-function feeder 19 is used for printing paper of sizes and types (calendered paper, etc) that differ from paper in the sheet cassette 14, or for printing a larger amount of paper than paper that can be held in the sheet cassette 12.

Double-side and single-side printings using the multi-function feeder 19 are the same as those using the manual inserting guide 10b, and an explanation is therefore not given here.

Besides the above described embodiments, the present invention can be modified as follows. First, although the process cartridge 2 in the embodiments has been described as an electrophotographic mechanism for charging, exposing, and developing, it can be employed in an electrophotographic system that simultaneously forms and develops an electrostatic latent image, or in a recording system, such as an electrostatic recording system, that develops and transfers an electrostatic latent image. Second, another medium besides paper can be used as a sheet PP. Third, although a printer has been described as an example of an image forming apparatus, other image forming apparatuses, such as copy machines and facsimiles, can be adapted. Fourth, a non-magnetic, one-component developer is used as a developer, but a well known developer, such as magnetic, one-component developer or two-component developer, can be used. Fifth, a sheet refeeding port is not limited to a manual inserting port, but may be a dedicated port and a dedicated path that are located at the same positions as the manual inserting port and the manual inserting path.

As described above, according to the present invention, since the area above a stacker of a feeding path is used as a switchback route, the size of a double-side image forming apparatus is prevented from becoming large. Further, since the portion above the stacker along the feeding path is employed as a switchback route, and the manual inserting port of a printer is used as a sheet refeeding port, a feeding path inside a sheet inverting unit can be shortened, and processing speed can be higher. Also, as the apparatus does not require a resist roller or the like, a sheet inverting unit can be manufactured compactly and at a lower cost. A double-side image forming apparatus can be provided at a low cost because a common, mass-produced single-side image forming apparatus can be utilized for this purpose without major modification.

What is claimed is:

1. A sheet inverting unit, which is detachable from an image forming apparatus having a sheet cassette, an image forming mechanism provided above the sheet cassette for forming an image on one side of a sheet, a stacker provided above the image forming mechanism, a feeding path along which the sheet supplied from the sheet cassette is conveyed to the stacker through the image forming mechanism, an inserting port for manual sheet feeding, and an inserting path for feeding an inserted sheet from the inserting port to the upstream origin of the feeding path for the image forming mechanism, for inverting the sheet bearing an image on one surface received from the image forming apparatus and feeding the image bearing sheet to the image forming apparatus, comprising:

a switching lever, provided downstream along the feeding path for the image forming mechanism, for selectively guiding the image bearing sheet either toward said stacker or upward from the image forming apparatus;

switchback rollers for feeding, upward of the stacker, the image bearing sheet that is guided upward by the switching lever and then inversely feeding the image bearing sheet;

a guide path, which extends from the switchback rollers to terminus in the vicinity of the inserting port of the image forming apparatus; and feeding rollers, provided along the guide path of the sheet inverting unit, for feeding the image bearing sheet to the image forming apparatus.

2. The sheet inverting unit according to claim 1, mounted on a front cover that can be opened to expose the feeding path of the image forming apparatus.

3. The sheet inverting unit according to claim 1, further comprising a single drive source for driving the switchback roller, the feeding rollers and the switching lever.

4. The sheet inverting unit according to claim 1, further comprising:

a base plate attached to the image forming apparatus, and a top cover, mounted pivotable on the base plate, for exposing a guide path that extends from the switchback rollers to an exit port of the sheet inverting unit.

5. A sheet inverting unit according to claim 1, wherein the guide path of the sheet inverting unit is designed to a guide a sheet that is manually inserted into the inserting port to a manual inserting guide.

6. The sheet inverting unit according unit according to claim 2, further comprising a single drive source for driving the switchback roller, the feeding rollers and the switching lever.

7. The sheet inverting unit according to claim 2, further comprising:

a base plate attached to the image forming apparatus, and a top cover, mounted pivotable on the base plate, for exposing a guide path that extends from the switchback rollers to an exit port of the sheet inverting unit.

8. The sheet inverting unit according to claim 2, wherein the guide path of the sheet inverting unit is designed to guide a sheet that is manually inserted into the inserting port to a manual inserting guide.

9. The sheet inverting unit according to claim 3, further comprising:

a base plate attached to the image forming apparatus, and a top cover, mounted pivotable on the base plate, for exposing a guide path that extends from the switchback rollers to an exit port of the sheet inverting unit.

10. A sheet inverting unit according to claim 3, wherein the guide path of the sheet inverting unit is designed to guide a sheet that is manually inserted into the inserting port to a manual inserting guide.

11. The sheet inverting unit according to claim 9, wherein the guide path of the sheet inverting unit is designed to guide a sheet that is manually inserted into the inserting port to a manual inserting guide.

12. A double-side image forming apparatus, for forming images on both sides of a sheet, comprising:

an image forming device for forming an image on one surface of a sheet, the image forming device having a sheet cassette for retaining sheets, an image forming mechanism provided above the sheet cassette for forming an image on one side of a sheet supplied from the sheet cassette;

a stacker provided above the image forming mechanism for holding an image bearing sheet, a feeding path along which the sheet supplied from the sheet cassette is conveyed first to the image forming mechanism and then to the stacker, a manual inserting port for manual sheet insertion, and a manual inserting path along which a manually inserted sheet is conveyed from the manual inserting port to the upstream origin of the feeding path for the image forming mechanism; and a sheet inverting unit for inverting and feeding a sheet bearing an image on one side to the image forming device, the sheet inverting unit having a switching lever provided downstream along the feeding path of the image forming mechanism for selectively guiding the image bearing sheet either toward the stacker or upward of the image forming device, switchback rollers for feeding, upward of the stacker, the image bearing sheet that is guided upward by said switching lever and then inversely feeding the image bearing sheet, a guide path that extends from the switchback rollers to a terminus in the vicinity of the manual inserting port of the image forming device, and feeding rollers provided along the guide path for feeding the image bearing sheet to the image forming device.

13. A double-side image forming apparatus according to claim 12, wherein the sheet inverting unit is detachable from the image forming device.

14. The double-side image forming apparatus according to claim 13, wherein the image forming device has a front cover that can be opened and closed to expose the feeding path, and the sheet inverting unit is provided on the front cover.

15. The double-side image forming apparatus according to claim 12, wherein the image forming mechanism includes an endless photosensitive carrier;

a charger for electrifying the photosensitive carrier, an optical unit for exposing the electrified photosensitive carrier to an image and forming an electrostatic latent image on the photosensitive carrier, a developing unit for developing the electrostatic latent image on the photosensitive carrier, a transfer unit for transferring a toner image from the photosensitive carrier to the sheet, and a fixing unit for fixing the toner image on the sheet, and wherein, above the fixing unit of the image forming mechanism along the feeding path in the image forming device, the switching level of the sheet inverting unit guides the sheet selectively to the stacker or upward of the image forming device.

16. The sheet inverting unit according to claim 12, further comprising a single drive source for driving the switchback roller, the feeding rollers and the switching lever.

17. The sheet inverting unit according to claim 12, further comprising:

a base plate attached to the image forming apparatus, and a top cover, mounted pivotable on the base plate, for exposing a guide path that extends from the switchback rollers to an exit port of the sheet inverting unit.

18. The double-side image forming apparatus according to claim 12, wherein the image forming device has a manual inserting guide for guiding a sheet manually inserted into the manual inserting port, and the guide path of the sheet inverting unit is designed to guide the sheet to the manual inserting guide.

19. A double-side image forming apparatus according to claim 13, wherein the image forming mechanism includes an endless photosensitive carrier:

a charger for electrifying the photosensitive carrier, an optical unit for exposing the electrified photosensitive carrier to an image and forming an electrostatic latent image on the photosensitive carrier, a developing unit for developing the electrostatic latent image on the photosensitive carrier, a transfer unit for transferring a toner image from the photosensitive carrier to the sheet, and a fixing unit for fixing the toner image on the sheet, and wherein, above the fixing unit of the image forming mechanism along the feeding path in the image forming device, the switching lever of the sheet inverting unit guides the sheet selectively to the stacker or upward of the image forming device.

20. The sheet inverting unit according to claim 13, further comprising a single drive source for driving the switchback roller, the feeding rollers and the switching lever.

21. The sheet inverting unit according to claim 13, further comprising:

a base plate attached to the image forming apparatus, and a top cover, mounted pivotable on the base plate, for exposing a guide path that extends from the switchback rollers to an exit port of the sheet inverting unit.

22. The double-side image forming apparatus according to claim 13, wherein the image forming device has a manual inserting guide for guiding a sheet manually inserted into the manual inserting port, and the guide path of the sheet inverting unit is designed to guide the sheet to the manual inserting guide.

23. The sheet inverting unit according to claim 15, further comprising a single drive source for driving the switchback roller, the feeding rollers and the switching lever.

24. The sheet inverting unit according to claim 15, further comprising:

a base plate attached to the image forming apparatus, and a top cover, mounted pivotable on the base plate, for opening a guide path that extends from the switchback rollers to an exit port of the sheet inverting unit.

25. The double-side image forming apparatus according to claim 15, wherein the image forming device has a manual inserting guide for guiding a sheet manually inserted into the manual inserting port, and the guide path of the sheet inverting unit is designed to guide the sheet to the manual inserting guide.

26. The sheet inverting unit according to claim 16, further comprising:

a base plate attached to the image forming apparatus, and a top cover, mounted pivotable on the base plate, for opening a guide path that extends from the switchback rollers to an exit port of the sheet inverting unit.

27. The double-side image forming apparatus according to claim 16, wherein the image forming device has a manual inserting guide for guiding a sheet manually inserted into the manual inserting port, and the guide path of the sheet inverting unit is designed to guide the sheet to the manual inserting guide.

28. A double-side image forming apparatus, for forming images on both sides of a sheet, comprising:

an image forming device for forming an image on one surface of a sheet, the image forming device having a sheet cassette for retaining sheets, an image forming mechanism provided above the sheet cassette for forming an image on one side of a sheet supplied from the sheet cassette, a stacker provided above the image forming mechanism for holding an image bearing sheet, a feeding path along which the sheet supplied from the sheet cassette is conveyed first to the image forming mechanism and then to the stacker, an insertion port for sheet insertion, and an insertion path along which an inserted sheet is conveyed from the insertion port to the upstream origin of the feeding path for the image forming mechanism; and a sheet inverting unit for inverting and feeding a sheet bearing an image on one side to the image forming device, the sheet inverting unit having a switching lever provided downstream along the feeding path of the image forming mechanism for selectively guiding the image bearing sheet either toward the stacker or upward of the image forming device, switchback rollers for feeding, upward of the stacker, the image bearing sheet that is guided upward by the switching lever and then inversely feeding the image bearing sheet, a guide path that extends from the switchback rollers to a terminus in the vicinity of the insertion port of the image forming device, and feeding rollers provided along the guide path for feeding the imager bearing sheet to the image forming device.

29. The double-side image forming apparatus according to claim 28, wherein the sheet inverting unit is detachable from the image forming device.

30. The double-side image forming apparatus according to claim 29, wherein the image forming device has a front cover that can be opened and closed to expose the feeding path, and the sheet inverting unit is provided on the front cover.

31. The double-side image forming apparatus according to claim 28, wherein the image forming mechanism includes an endless photosensitive carrier;

a charger for electrifying the photosensitive carrier, an optical unit for exposing the electrified photosensitive carrier to an image and forming an electrostatic latent image on the photosensitive carrier, a developing unit for developing the electrostatic latent image on the photosensitive carrier, a transfer unit for transferring a toner image from the photosensitive carrier to the sheet, and a fixing unit for fixing the toner image on the sheet, and wherein, above the fixing unit of the image forming mechanism along the feeding path in the image forming device, the switching lever of the sheet inverting unit guides the sheet selectively to the stacker or upward of the image forming device.

32. The sheet inverting unit according to claim 28, further comprising a single drive source for driving the switchback roller, the feeding rollers and the switching lever.

33. The sheet inverting unit according to claim 28, further comprising:

a base plater attached to the image forming apparatus, and a top cover, mounted pivotable on the base plate, for opening a guide path that extends from the switchback rollers to an exit port of the sheet inverting unit.

34. A double-side image forming apparatus, for forming images on both sides of a sheet, comprising:

a sheet cassette for retaining sheets;

an image forming mechanism, provided above the sheet cassette, for forming an image on one side of a sheet supplied from the sheet cassette;

a stacker, provided above the image forming mechanism, for holding an image bearing sheet;

a feeding path, along which the sheet supplied from the sheet cassette is conveyed first to the image forming mechanism and then to the stacker;

an insertion port for sheet insertion;

an insertion path, along which an inserted sheet is conveyed from the insertion port to the upstream origin of the feeding path for the image forming mechanism;

a sheet exit port provided downstream along the feeding path of the image forming mechanism;

a switching lever, provided downstream along the feeding path of the image forming mechanism, for selectively guiding the image bearing sheet either toward the stacker or toward the sheet exit port;

switchback rollers for feeding, upward of the stacker, the image bearing sheet guided toward the sheet exit port by the switching lever and then inversely feeding the image bearing sheet;

a guide path that extends from the switchback rollers to a terminus in the vicinity of the insertion port; and feeding rollers, provided along the guide path, for feeding the image bearing sheet to the insertion port.

* * * * *